US007806521B2

(12) United States Patent
Sugahara

(10) Patent No.: US 7,806,521 B2
(45) Date of Patent: Oct. 5, 2010

(54) LIQUID TRANSPORT APPARATUS AND METHOD FOR PRODUCING LIQUID TRANSPORT APPARATUS

(75) Inventor: Hiroto Sugahara, Aichi-ken (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 664 days.

(21) Appl. No.: 11/881,347

(22) Filed: Jul. 26, 2007

(65) Prior Publication Data

US 2008/0030556 A1 Feb. 7, 2008

(30) Foreign Application Priority Data

Aug. 1, 2006 (JP) ..... 2006-209881

(51) Int. Cl.
*B41J 2/175* (2006.01)

(52) U.S. Cl. ..... 347/85; 347/68; 347/71

(58) Field of Classification Search ..... 347/85, 347/68, 71
See application file for complete search history.

(56) References Cited

U.S. PATENT DOCUMENTS

| | | | | |
|---|---|---|---|---|
| 6,846,069 | B2 | 1/2005 | Ito et al. | |
| 7,213,910 | B2 | 5/2007 | Chikamoto | |
| 7,380,318 | B2 * | 6/2008 | Wada et al. | 29/25.35 |
| 2003/0025768 | A1 * | 2/2003 | Koike et al. | 347/68 |
| 2005/0036006 | A1 | 2/2005 | Watanabe | |
| 2005/0116992 | A1 * | 6/2005 | Akahane | 347/54 |
| 2006/0098046 | A1 | 5/2006 | Katayama | |

FOREIGN PATENT DOCUMENTS

| | | |
|---|---|---|
| EP | 1277583 A2 | 1/2003 |
| EP | 13212940 A2 | 5/2003 |
| JP | 2002-219813 | 8/2002 |
| JP | 2004-167974 | 6/2004 |
| JP | 2005-22184 | 1/2005 |

* cited by examiner

*Primary Examiner*—Ellen Kim
(74) *Attorney, Agent, or Firm*—Frommer Lawrence & Haug LLP

(57) ABSTRACT

A liquid transport apparatus constructed by stacking a plurality of plates includes a flow passage unit having pressure chambers, a common liquid chamber, and communication flow passages communicating the pressure chambers and the common liquid chamber, and a pressure-applying mechanism which applies a pressure to the liquid in the pressure chambers. The plurality of plates include a first plate and a second plate joined to a surface of the first plate. A recess, which has an opening at the surface and which constructs the common liquid chamber, is formed for the first plate. A projection extends from the bottom wall of the recess to make contact with the second plate. Therefore, when the plurality of plates are stacked and joined to one another, it is possible to sufficiently apply a pressure to the portion overlapped with the common liquid chamber, and the plates make tight contact with each other.

18 Claims, 15 Drawing Sheets

LIQUID TRANSPORT APPARATUS AND METHOD FOR PRODUCING LIQUID TRANSPORT APPARATUS

CROSS REFERENCE TO RELATED APPLICATION

The present application claims priority from Japanese Patent Application No. 2006-209881, filed on Aug. 1, 2006, the disclosure of which is incorporated herein by reference in its entirety.

BACKGROUND OF THE INVENTION

1. Field of the Invention

The present invention relates to a liquid transport apparatus for transporting a liquid in a pressure chamber, and a method for producing the liquid transport apparatus.

2. Description of the Related Art

A certain liquid transport apparatus for transporting a liquid in a pressure chamber is known, in which a plurality of pressure chambers and a common liquid chamber for supplying the liquid to the plurality of pressure chambers are formed by stacking a plurality of plates. For example, in the case of an ink-jet head (liquid transport apparatus) shown in FIG. 4 of U.S. Pat. No. 7,213,910 (corresponding to Japanese Patent Application Laid-open No. 2005-22184), a flow passage unit, which has a plurality of pressure chambers and a manifold (common liquid chamber) communicated with the plurality of pressure chambers, is formed by mutually stacking nine plates.

In this case, when such a flow passage unit is manufactured, then the plurality of plates are stacked, and the plurality of plates are joined to one another while pressing them in the stacking direction. However, in the case of the ink-jet head described in U.S. Pat. No. 7,213,910, the common liquid chamber, which is a relatively large space, is formed when the plurality of plates are stacked. Therefore, when the plurality of plates is joined to one another, the pressure is hardly applied to the portions of the plurality of plates overlapped with the common liquid chamber. For this reason, the plates are not sufficiently adhered to one another around the portions of the plurality of plates overlapped with the common liquid chamber, and there is a fear that any gap is formed between the plates and that thus the liquid may leak from the gap.

SUMMARY OF THE INVENTION

An object of the present invention is to provide a liquid transport apparatus which prevents the liquid from leaking from the gap between the plates, and a method for producing the liquid transport apparatus. Parenthesized numerals or symbols, which are affixed to respective elements described below, merely exemplify the elements by way of example, with which it is not intended to limit the respective elements.

According to a first aspect of the present invention, there is provided a liquid transport apparatus (3) constructed by stacking a plurality of plates (21, 22, 23, 24, 160, 27, 40), the apparatus including: a flow passage unit (30) which has liquid flow passages (10, 11, 12, 13, 14) including a plurality of pressure chambers (10), a common liquid chamber (11) supplying a liquid to the plurality of pressure chambers, and communication flow passages (12, 13, 14) communicating the plurality of pressure chambers and the common liquid chamber; and a pressure-applying mechanism (31) which applies a pressure to the liquid in the plurality of pressure chambers; wherein the plurality of plates include a first plate (160) and a second plate (24) which is joined to a surface of the first plate; a recess (161), which has an opening at the surface and which constructs the common liquid chamber, is formed in the first plate; a projection (162, 163) is formed in the recess to extend in the recess from a bottom wall of the recess to make contact with the second plate; and the second plate makes contact with the surface of the first plate and a forward end of the projection to close the opening therewith.

According to the liquid transport apparatus of the present invention, the recess, which constructs the common liquid chamber, is formed in the first plate. The projection protrudes from the bottom wall of the recess, and the forward end of the projection makes contact with the second plate. Therefore, when the plurality of plates are joined to one another, the pressure can be sufficiently applied to the portions of the plurality of plates overlapped with the projection, i.e., the portions overlapped with the common liquid chamber as viewed in the stacking direction. Accordingly, the plates sufficiently make tight contact with each other even at the portions of the plurality of plates overlapped with the common liquid chamber. Therefore, it is possible to avoid the inconvenience which would be otherwise caused such that any gap appears between the joined plates, and the liquid leaks from the gap. Further, the pressure wave is absorbed in the common liquid chamber by the projection provided in the common liquid chamber (recess). Therefore, it is possible to efficiently attenuate the pressure wave. Further, the flow passage resistance is increased in the common liquid chamber owing to the fact that the projection is provided. Accordingly, for example, even when the liquid is continuously supplied from the common liquid chamber to the plurality of pressure chambers, any flow of the liquid is hardly caused in the common liquid chamber. Therefore, even when the supply of the liquid is suddenly stopped for a certain pressure chamber to which the liquid has been continuously supplied, it is possible to avoid the outflow of the liquid which would be otherwise caused by the flow from the common liquid chamber to the pressure chamber for which the supply of the liquid has been stopped.

In the liquid transport apparatus (3) of the present invention, the plurality of plates (21, 22, 23, 24, 25, 26, 27, 40) may include a plurality of first plates (25, 26) and one piece of the second plate (24); and the plurality of first plates may be stacked adjacent to each other. The second plate may be joined to a surface of a first plate which is positioned on an outermost side among the plurality of first plates; and a first through-hole, which penetrates through each of the first plates, may be formed through each of the plurality of first plates at a position different from that of the projection of the bottom wall of the recess. In this case, when the plurality of first plates, through which the first through-holes are formed respectively, are stacked, the recesses, which are formed in the first plates respectively, are communicated with each other via the first through-holes to form one common liquid chamber. Therefore, the volume of the common liquid chamber can be sufficiently secured, and the pressure wave can be efficiently attenuated in the common liquid chamber.

In the liquid transport apparatus (3) of the present invention, the projections (52, 62), which are formed on the plurality of first plates (25, 26) respectively, may be overlapped with each other at least partially. In this case, large pressure can be applied to the portions of the plurality of plates overlapped with the projections owing to the fact that the projections are overlapped with each other at least partially.

In the liquid transport apparatus (3) of the present invention, all of the plurality of first plates (25, 26) may have an identical shape. In this case, the projections are completely overlapped with each other, because the plurality of first plates have the identical shape. Therefore, it is possible to apply larger pressure to the portions of the plurality of plates overlapped with the projections. Further, the production of the liquid transport apparatus is simplified, because it is possible to decrease the types of parts.

In the liquid transport apparatus (3) of the present invention, the projection may be formed as a plurality of projections (52, 62) and the first through-hole may be formed as a plurality of first through-holes (54, 64) in each of the plurality of first plates (25, 26); and all of the plurality of pressure chambers (10) and all of the projections and the first through-holes, formed in the vicinity of the plurality of pressure chambers respectively, may be in a same positional relationship. In this case, the flow passages can be constructed to be same around the respective pressure chambers. Therefore, it is possible to avoid the occurrence of any deviation, between the pressure chambers, for example, in relation to the transport amount and transport velocity of the liquid when the pressure is applied to the liquid in the pressure chambers by the actuator.

In the liquid transport apparatus (3) of the present invention, the plurality of pressure chambers (10) may be arranged at equal intervals in one direction, and the plurality of projections (52, 62) and the plurality of first through-holes (54, 64) may be arranged at equal intervals in the one direction respectively. In this case, when the pressure chambers are arranged at equal intervals in one direction, the flow passages can be constructed to be same around the respective pressure chambers by arranging the projections and the first through-holes at equal intervals in one direction respectively.

In the liquid transport apparatus (3) of the present invention, the projection may be formed as a plurality of projections (52, 62) and the first through-hole may be formed as a plurality of first through-holes (54, 64) in each of the plurality of first plates (25, 26); and each of the first through-holes may be formed between two adjoining projections among the plurality of projections. In this case, the plurality of projections and the plurality of first through-holes are arranged uniformly in the common liquid chamber. Accordingly, the flow passage resistance is uniform in the common liquid chamber. Therefore, the liquid is reliably supplied from the common liquid chamber to all of the pressure chambers.

In the liquid transport apparatus (3) of the present invention, the plurality of plates (21, 22, 23, 24, 25, 26, 27, 40) may further include a third plate (21) which is arranged on a side opposite to the first plate (25, 26) with respect to the second plate (24) and which constructs the plurality of pressure chambers (10); and flow passage holes (14) constructing the communication flow passages may be formed through the second plate. Further, the recess (51, 61) may be formed to have an area covering the plurality of pressure chambers; and the projection (52, 62) may be formed between two adjoining pressure chambers among the plurality of pressure chambers. In this case, the projection is formed to be overlapped with a portion which serves as a side wall of the two adjoining pressure chambers. Therefore, large pressure can be applied to the projections when the plurality of plates are joined to one another. Therefore, the plurality of plates can be joined to one another in a state in which the plurality of plates is allowed to reliably make tight contact with each other.

In the liquid transport apparatus (3) of the present invention, the plurality of plates (21, 22, 23, 24, 25, 26, 27, 40) may further include a third plate (21) which is arranged on a side opposite to the first plate (25, 26) with respect to the second plate (24) and which constructs the plurality of pressure chambers (10); and flow passage holes (14) constructing the communication flow passages may be formed through the second plate. Further, the recess (51, 61) may be formed to have an area covering the plurality of pressure chambers; and the projection (52, 62) may be formed at a portion overlapped with the plurality of pressure chambers. Among the portions of the plurality of plates overlapped with the common liquid chamber, the spaces to serve as the pressure chambers are also formed, in addition to the space to serve as the common liquid chamber, at the portions which are overlapped with the pressure chambers. Therefore, the pressure is especially hardly applied to such portions. However, according to the above structure, the projection is formed at the portion overlapped with the pressure chambers. Therefore, the pressure can be sufficiently applied to the portions of the plurality of plates overlapped with the pressure chambers as well. Therefore, the plurality of plates can be joined to one another in a state in which they are allowed to sufficiently make tight contact with each other.

In the liquid transport apparatus (3) of the present invention, the plurality of plates (21, 22, 23, 24, 25, 26, 27, 40) may further include a third plate (21) which is arranged on a side opposite to the first plate (25, 26) with respect to the second plate (24) and which constructs the plurality of pressure chambers (10), and flow passage holes (14) constructing the communication flow passages may be formed through the second plate. Further, the plurality of pressure chambers may form a plurality of pressure chamber rows (8) in which the pressure chambers are arranged at equal intervals in one direction; the recess (51, 61) may be formed to have an area covering the plurality of pressure chamber rows; and the projection may be formed in the recess as a plurality of projections (52, 53, 62, 63). A part (53, 63) of the plurality of projections may be arranged at equal intervals in the one direction corresponding to the plurality of pressure chambers; and a plurality of second through-holes (15*d*, 15*e*), which penetrate through the first plate, may be formed in the part of the projections. The plurality of second through-holes may construct transport flow passages (15) which are communicated with the plurality of pressure chambers to transport the liquid in the plurality of pressure chambers; and portions of the recess, which are overlapped with the plurality of pressure chamber rows, may be communicated with each other via portions located between the part of the projections (53, 63) through which the second through-holes are formed. In this case, the recess is formed to have an area covering the plurality of pressure chamber rows, the part of the plurality of projections is arranged corresponding to the plurality of pressure chambers, and the second through-holes, which construct the transport flow passages to transport the liquid in the pressure chambers, are formed therein. Owing to this construction, the portions of the recess, which are overlapped with the plurality of pressure chamber rows, are communicated with each other via the portions located between the part of the projections through which the second through-holes are formed. Therefore, the volume of the common liquid chamber can be sufficiently secured. Accordingly, the pressure wave can be sufficiently absorbed in the common liquid chamber.

In the liquid transport apparatus (3) of the present invention, the projection (52, 53, 62, 63) may have a columnar shape. In this case, the volume of the common liquid chamber can be sufficiently secured while increasing the area of the portion of the projection to which the pressure is applied during the joining operation, by constructing the projection to have the columnar shape.

The liquid transport apparatus (3) of the present invention may be a liquid-jetting apparatus (3) further comprising a nozzle plate (27) through which a plurality of nozzles (16) are formed, the plurality of nozzles being communicated with the plurality of pressure chambers (8) to jet the liquid. Also in this case, the pressure can be sufficiently applied to the portions, of the plurality of plates, overlapped with the common liquid chamber. Therefore, it is possible to avoid the inconvenience which would be otherwise caused such that any gap is defined between the joined plates in the liquid-jetting apparatus, and to avoid any liquid leakage from the gap.

According to a second aspect of the present invention, there is provided a method for producing a liquid transport apparatus (3), comprising forming, through a plurality of plates (21, 22, 23, 24, 160, 40), flow passage holes constructing liquid flow passages (10, 11, 12, 13, 14) including a plurality of pressure chambers (10), a common liquid chamber (11) supplying a liquid to the plurality of pressure chambers, and communication flow passages (12, 13, 14) communicating the plurality of pressure chambers and the common liquid chamber; forming a flow passage unit (30) having the liquid flow passages formed therein by stacking the plurality of plates through which the flow passage holes are formed; and providing, on the flow passage unit, a pressure-applying mechanism (31) applying a pressure to the liquid in the plurality of pressure chambers; wherein the plurality of plates include a first plate (160) and a second plate (24) which is joined to a surface of the first plate; and when the flow passage holes are formed, a recess (161) which has an opening on the surface of the first plate and which constructs the common liquid chamber and a projection (162, 163) which extends from a bottom wall of the recess to make contact with the second plate are formed in the first plate.

According to the method for producing the liquid transport apparatus of the present invention, the recess is formed in the first plate, and the projection, which extends from the bottom wall of the recess to make contact with the second plate, is formed in the first plate. Accordingly, the projection makes contact with the second plate in the formation of the flow passage unit. Therefore, the pressure can be also applied to the portions of the plurality of plates overlapped with the projection as viewed in the stacking direction. Therefore, the joining can be performed in a state in which the plates are allowed to reliably make tight contact with each other even in the areas overlapped with the common liquid chamber.

In the method for producing the liquid transport apparatus (3) of the present invention, the plurality of plates (21, 22, 23, 24, 25, 26, 40, 41) may include a plurality of first plates (25, 26) and one piece of the second plate (24); and through-holes (54, 64), which penetrate through the first plate, may be formed at positions different from that of the projection (52, 62) of the bottom wall of the recess (51, 61) in the formation of the flow passage holes. The plurality of plates may be stacked in the formation of the flow passage unit so that the plurality of first plates are disposed adjacently to one another and that the second plate is joined to a surface of a first plate which is positioned on an outermost side among the plurality of first plates. According to this method, by stacking the plurality of first plates, the recesses of the respective first plates are made to communicate with each other via the through-holes to form one common liquid chamber. Therefore, the volume of the common liquid chamber can be sufficiently secured.

In the method for producing the liquid transport apparatus (3) of the present invention, in the formation of the flow passage holes, the recess (51, 61) and the projection may be formed by performing half etching to a portion to be formed into the common liquid chamber (11) which is different from a portion at which the projection (52, 53, 62, 63) is formed, from the surface of the first plate (25, 26). According to this method, the recess and the projection can be easily formed in the first plate by performing the half etching from the surface of the first plate.

In the method for producing the liquid transport apparatus (3) of the present invention, in the formation of the flow passage holes, the through-holes may be formed by performing etching to portions, at which the through-holes (54, 15*d*, 64, 15*e*) are formed, from a surface on a side opposite to the surface of the first plate (25, 26). According to this method, the through-holes can be easily formed in the first plate by performing the etching from the surface, on the side opposite to the recess, of the first plate.

In the method for producing the liquid transport apparatus (3) of the present invention, the plurality of plates (21, 22, 23, 24, 25, 26, 40) may be joined to one another with an adhesive in the formation of the flow passage unit. When the plates are joined to one another with the adhesive, it is necessary that the plates are brought into sufficiently tight contact with each other. According to this method, when the joining is performed, the pressure can be also applied to the portions of the plurality of plates overlapped with the projection. Therefore, the plates can be adhered to one another with the adhesive in a state in which the plates are allowed to sufficiently make tight contact with each other.

In the method for producing the liquid transport apparatus (3) of the present invention, the plurality of plates (21, 22, 23, 24, 25, 26, 40) may be formed of a metal material; and the plurality of plates may be joined to one another by metal diffusion bonding in the formation of the flow passage unit. According to this method, when the plates are formed of the metal material, the plates can be reliably joined to one another by the metal diffusion bonding. When the plates are joined to one another by the metal diffusion bonding, it is necessary that the plates are allowed to sufficiently make tight contact with each other. According to this method, when the joining is performed, the pressure can be also applied to the portions of the plurality of plates overlapped with the projection. Therefore, the metal diffusion bonding can be performed in a state in which the plates are allowed to sufficiently make tight contact with each other.

DESCRIPTION OF THE PREFERRED EMBODIMENTS

Preferred embodiments of the present invention will be explained below.

Figure 1:
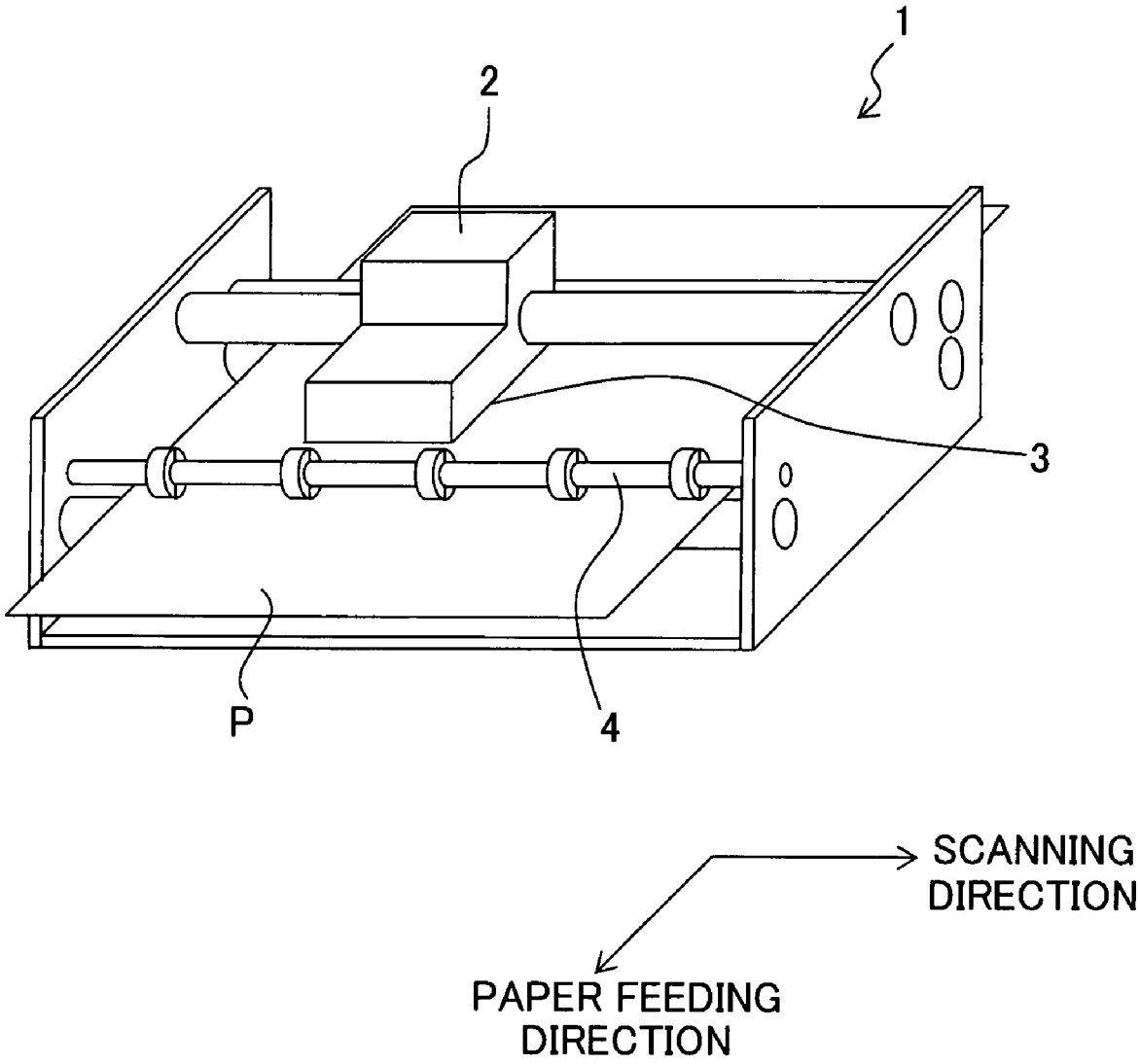
FIG. 1 shows a schematic arrangement illustrating a printer according to an embodiment of the present invention.

FIG. 1 shows a schematic arrangement illustrating a printer 1 according to an embodiment of the present invention. As shown in FIG. 1, the printer 1 is provided with, for example, a carriage 2, an ink-jet head 3 (liquid transport apparatus, liquid-jetting apparatus), and a printing paper transport roller 4. The carriage 2 reciprocates in the scanning direction (left-right direction as shown in FIG. 1). The ink-jet head 3 is attached to the lower surface of the carriage 2. The ink-jet head 3 discharges inks from nozzles 16 (see FIG. 2) formed on the lower surface of the ink-jet head 3 while reciprocating in the scanning direction together with the carriage 2. The printing paper transport roller 4 transports the recording paper P in the paper feeding direction (direction directed toward the front of FIG. 1). The printer 1 performs the printing on the printing paper P such that the ink is discharged onto the recording paper P which is transported by the printing paper transport roller 4 in the paper feeding direction from the ink-jet head 3 which reciprocates in the scanning direction together with the carriage 2. The recording paper P, on which the printing has been completed, is discharged by the printing paper transport roller 4.

Figure 8:
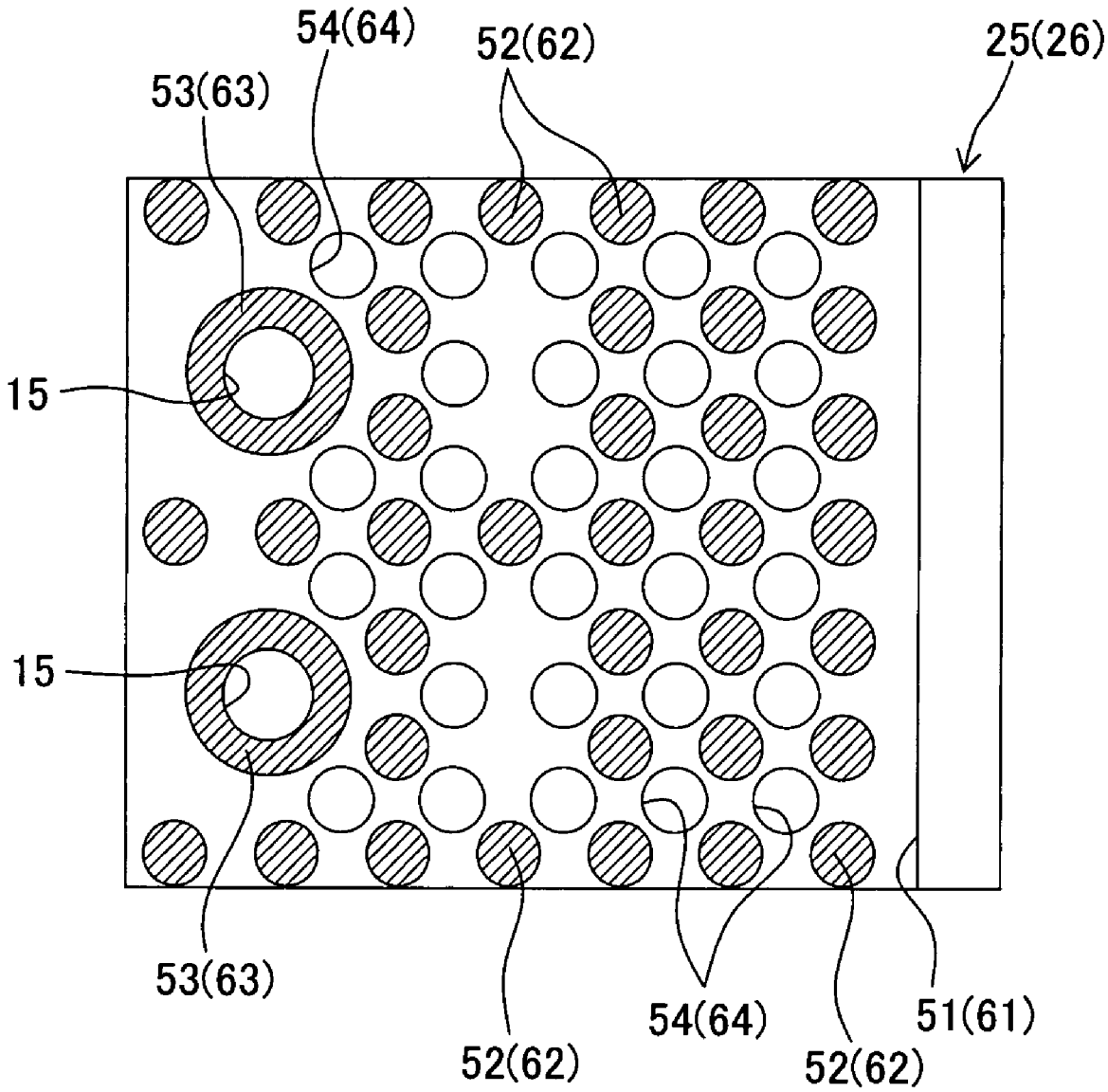
FIG. 8 shows a plan view illustrating a manifold plate shown in FIGS. 4 to 7.

Next, the ink-jet head 3 will be explained with reference to FIGS. 2 to 8. However, in order to depict the drawings more comprehensively, projections 52, 53, 62, 63 described later on are illustrated by dashed lines in FIGS. 2 and 3, and through-holes 54, 64 are illustrated by broken lines. In FIG. 8, the portions, at which the projections 52, 53, 62, 63 are formed, are hatched.

As shown in FIGS. 2 to 7, the ink-jet head 3 has a flow passage unit 30 which is formed with ink flow passages including a manifold flow passage (common liquid chamber) 11 and pressure chambers 10, and a piezoelectric actuator (pressure-applying mechanism) 31 which applies the pressure to the ink in the pressure chamber 10.

As shown in FIGS. 2 to 7, the flow passage unit 30 is constructed by mutually stacking seven plates of a cavity plate 21, a base plate 22, an aperture plate 23, a supply plate 24, two pieces of manifold plates 25, 26, and a nozzle plate 27 in this order from the top. Each of the seven plates 21 to 27 is composed of a metal material. In the embodiment of the present invention, the manifold plates 25, 26 correspond to the first plate as defined in claims of the present invention, the supply plate 24 corresponds to the second plate as defined in claims of the present invention joined to the upper surface of the manifold plate 25 (a surface of the first plate which is positioned on the outermost side), and the cavity plate 21 corresponds to the third plate as defined in claims of the present invention provided over the supply plate 24 (on a side opposite to the manifold flow passage 25 with respect to the supply plate 24).

Figure 2:
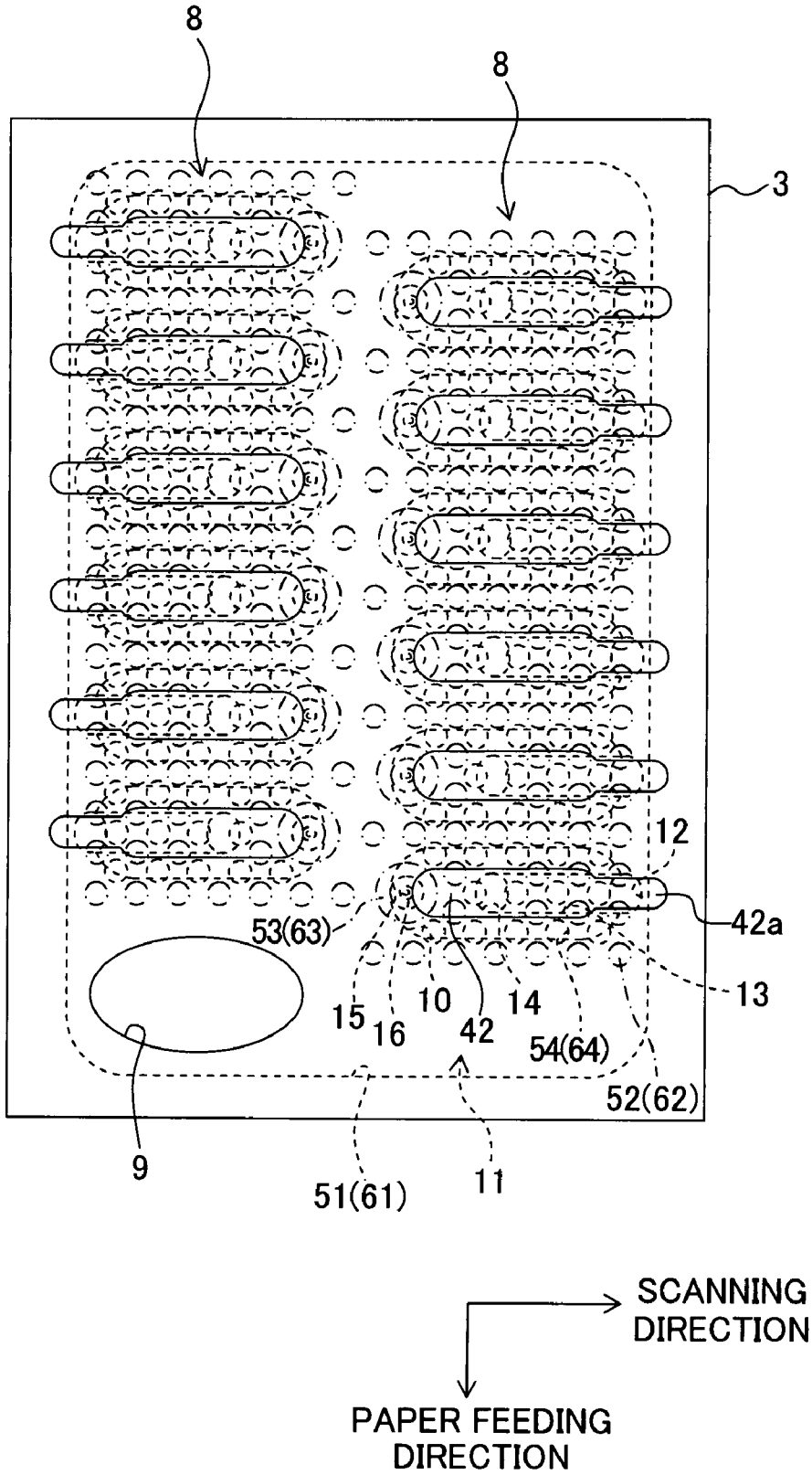
FIG. 2 shows a plan view illustrating an ink-jet head shown in FIG. 1.
Figure 3:
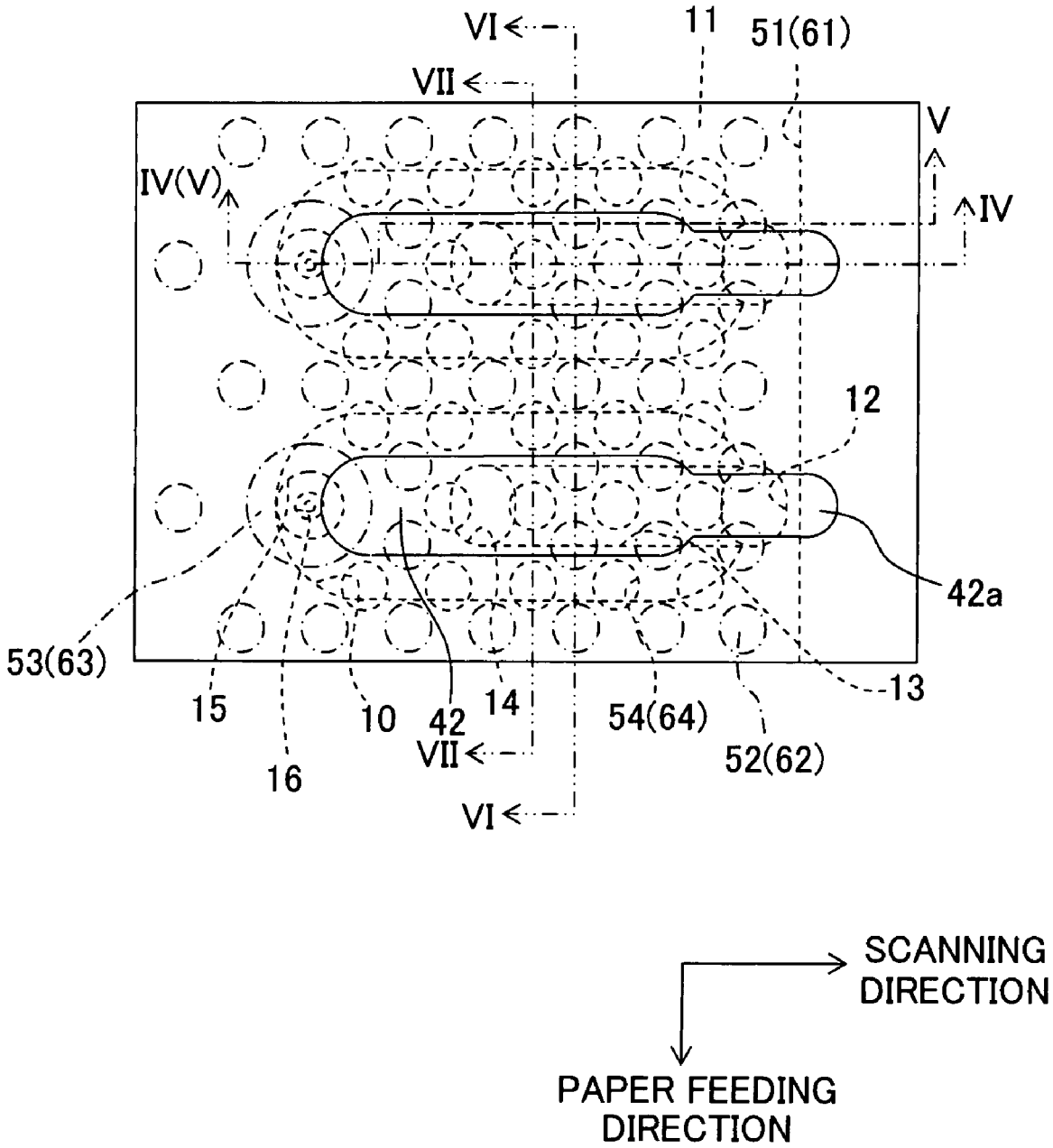
FIG. 3 shows a partial magnified view illustrating those shown in FIG. 2.

A plurality of pressure chambers 10 are formed through the cavity plate 21, and the cavity plate 21 defines the pressure chambers 10. The plurality of pressure chambers 10 have substantially elliptical planar shapes which are long in the scanning direction (left-right direction as shown in FIG. 2). Six of the pressure chambers 10 are arranged in the paper feeding direction (upward-downward direction as shown in FIG. 2) to form pressure chamber rows 8. The two pressure chamber rows 8 are arranged in the scanning direction (left-right direction as shown in FIG. 2). A plurality of through-holes 12 are formed through the base plate 22 at the ends of the plurality of pressure chambers 10 disposed on one side in the longitudinal direction (on the outer side with respect to the left-right direction as shown in FIG. 2) as viewed in a plan view (as viewed in the stacking direction of the plates 21 to 27). Through-holes 15*a* are formed through the base plate 22 at the ends of the pressure chambers 10 disposed on the other side (inner side with respect to the left-right direction as shown in FIG. 2) in the longitudinal direction as viewed in a plan view.

Apertures 13, which serve as throttles and which extend in the longitudinal direction of the pressure chambers 10 from the portions overlapped with the through-holes 12 as viewed in a plan view to the substantially central portions of the pressure chambers 10, are formed through the aperture plate 23. Through-holes 15*b* are formed through the aperture plate 23 at the positions overlapped with the through-holes 15*a* as viewed in a plan view. Through-holes 14 are formed through the supply plate 24 at the positions overlapped with the ends of the apertures 13 disposed on the side opposite to the through-holes 12 as viewed in a plan view. Through-holes 15*c* are formed through the supply plate 24 at the positions overlapped with the through-holes 15*b* as viewed in a plan view.

The manifold plate 25 is formed with a recess 51 which has an opening at the upper surface thereof (one surface) and which extends having an area covering the two pressure chamber rows 8 as viewed in a plan view. A plurality of projections 52, 53 and a plurality of through-holes (first through-holes) 54 are formed for the recess 51. The opening of the recess 51 is closed by the supply plate 24 stacked on the upper surface of the manifold plate 25.

The plurality of projections 52 have substantially columnar shapes. The plurality of projections 52 extend from the bottom wall of the recess 51 to make contact with the supply plate 24. The forward ends of the plurality of projections 52 are joined to (allowed to make contact with) the lower surface of the supply plate 24. The plurality of projections 52 are arranged at equal intervals in the upward-downward direction (one direction) and the left-right direction as shown in FIG. 2. Parts of the plurality of projections 52 are arranged at the positions overlapped with the pressure chambers 10 as viewed in a plan view and at the positions overlapped with the portions disposed between the adjoining pressure chambers 10 (portions which serve as the side walls of the pressure chambers 10).

The plurality of projections 53 have substantially columnar shapes, and they are arranged in the areas of the plurality of through-holes 15*c* formed to correspond to the plurality of pressure chambers 10 as viewed in a plan view and in the areas to surround the plurality of through-holes 15*c* (the plurality of projections 53 are arranged at equal intervals in the upward-downward direction as shown in FIG. 2 corresponding to the plurality of pressure chambers 10). The plurality of projections 53 extend from the bottom wall of the recess 51 to make contact with the supply plate 24. The forward ends of the plurality of projections 53 are joined to the lower surface of the supply plate 24. Through-holes (second through-holes) 15*d* are formed through the plurality of projections 53 at the portions overlapped with the through-holes 15*c* as viewed in a plan view. The portions of the recess 51, which are overlapped with the two pressure chamber rows 8 as viewed in a plan view, are communicated with each other through the portions disposed between the adjoining projections 53.

The plurality of through-holes 54 are arranged at equal intervals in the upward-downward direction and the left-right direction as shown in FIG. 2. The plurality of through-holes 54 are arranged, as viewed in a plan view, at the positions deviated from the plurality of projections 52 by a half of the spacing distance between the two adjoining projections 52 with respect to the upward-downward direction and the left-right direction as shown in FIG. 2 (the plurality of through-holes 54 are formed at the positions different from those of the projections 52, 53 of the bottom wall of the recess 51). In other words, the rows of the plurality of through-holes 54, which are arranged in the upward-downward direction as shown in FIG. 2, are arranged between the rows of the plurality of projections 52 arranged in the upward-downward direction as shown in FIG. 2.

The manifold plate 26 has the same shape as that of the manifold plate 25. The manifold plate 26 is formed with a recess 61, a plurality of projections 62, a plurality of projections 63, and a plurality of through-holes 64 (first through-holes). The recess 61 is equivalent to the recess 51, which has the opening closed by the manifold plate 25. The plurality of projections 62, 63 are equivalent to the plurality of projections 52, 53 respectively. The forward ends thereof are joined to the lower surface of the manifold plate 25. Through-holes (second through-holes) 15*e*, which are equivalent to the through-holes 15*d*, are formed through the plurality of projections 63. The plurality of through-holes 64 are equivalent to the plurality of through-holes 54.

The manifold plate 25 and the manifold plate 26 are stacked with each other and adjoining to one another. Accordingly, the recess 51 and the recess 61 are communicated with each other via the through-holes 54, and the manifold flow passage 11 is formed. The ink is supplied to the manifold flow passage 11 from an ink supply port 9 formed for the vibration plate 40 as described later on.

In this case, as shown in FIG. 2, the recesses 51, 61 are formed while ranging over (having an area covering) the two pressure chamber rows 8. The plurality of projections 53, 63 are formed between the portions of the recesses 51, 61 overlapped with the two pressure chamber rows 8 respectively as viewed in a plan view. Therefore, the portions of the recesses 51, 61, which are overlapped with the two pressure chamber rows 8 as viewed in a plan view, are communicated with each other via the portions disposed between the projections 53, 63 respectively.

As described above, the manifold flow passage 11 is formed to range over the recess 51 and the recess 61 with respect to the stacking direction. Further, the manifold flow passage 11 is formed to range over the two pressure chamber rows 8 as viewed in a plan view. Therefore, the volume of the manifold flow passage 11 can be sufficiently secured. Accordingly, the pressure wave, which is generated when the pressure is applied to the ink in the pressure chamber 10 as described later on, can be sufficiently attenuated in the manifold flow passage 11.

The flow passage resistance of the manifold flow passage 11 is increased owing to the fact that the projections 52, 53, 62, 63 are provided in the manifold flow passage 11. Therefore, it is possible to avoid any unnecessary outflow of the liquid from the manifold flow passage 11 to the pressure chamber 10.

The plurality of projections 52, 53, 62, 63 and the through-holes 54, 64 are arranged at the equal intervals in the upward-downward direction as shown in FIG. 2 in the same manner as the plurality of pressure chambers 10. Therefore, all of the plurality of pressure chambers 10 and all of the projections 52, 53, 62, 63 and the through-holes 54, 64 arranged in the vicinity of the pressure chambers 10 respectively are in a same positional relationship. Accordingly, the flow passage resistance is uniformized around the plurality of pressure chambers 10 in the manifold flow passage 11. The occurrence of any dispersion in the discharge characteristic of the ink is suppressed, for example, with respect to the discharge volume of the ink and the discharge velocity of the ink to be discharged from the plurality of nozzles 16.

Further, the rows of the through-holes 54, 64 arranged in the upward-downward direction as shown in FIG. 2 are arranged between the rows of the projections 52, 62 arranged in the upward-downward direction as shown in FIG. 2. Therefore, the projections 52 and the through-holes 54 as well as the projections 62 and the through-holes 64 are arranged uniformly respectively in the manifold flow passage 11. Accordingly, the flow passage resistance is uniform in the entire region of the manifold flow passage 11. The ink can be reliably supplied from the manifold flow passage 11 to all of the pressure chambers 10.

The plurality of nozzles 16 are formed through the nozzle plate 27 at the positions overlapped with the plurality of through-holes 15*e* as viewed in a plan view. The nozzle plate 27 closes the openings of the through-holes 64 at the lower surface of the manifold plate 26. The seven plates 21 to 27 are stacked, and thus the manifold flow passage 11 is communicated with the plurality of pressure chambers 10 via the through-holes 14, the apertures 13, and the through-holes 12. The plurality of pressure chambers 10 are communicated with the nozzles 16 respectively via the descender flow passages (transport flow passages) 15 formed by superimposing or overlapping the through-holes 15*a* to 15*e*. In this way, the plurality of individual ink flow passages, which communicates from the outlet of the manifold flow passage 11 via the pressure chambers 10 to the nozzles 16, are formed in the flow passage unit 30. In this case, the flow passage, which is constructed by the aperture 13 and the through-holes 12, 14 and which communicates the manifold flow passage 11 and the pressure chamber 10, corresponds to the communication flow passage according to the present invention.

Next, the piezoelectric actuator 31 will be explained. The piezoelectric actuator 31 has a vibration plate 40, a piezoelectric layer 41, and a plurality of individual electrodes 42.

The vibration plate 40 is formed of a metal material. The vibration plate 40 is joined to the upper surface of the cavity plate 21 so that the plurality of pressure chambers 10 are covered therewith. The vibration plate 40 is conductive. The vibration plate 40 also serves as the common electrode to interpose the piezoelectric layer 41 between the individual electrodes 42 and the vibration plate 40. The vibration plate 40 is always retained at the ground electric potential.

The piezoelectric layer 41 is a solid solution of lead titanate and lead zirconate, which is formed of a piezoelectric material containing lead titanate zirconate (PZT) as a major component. The piezoelectric layer 41 is formed on the upper surface of the vibration plate 40 while ranging over the plurality of pressure chambers 10. The piezoelectric layer 41 is previously polarized in the thickness direction.

The plurality of individual electrodes 42 is formed of a conductive material such as metal. The plurality of individual electrodes 42 have substantially elliptical shapes which are one size smaller than those of the pressure chambers 10 as viewed in a plan view. The plurality of individual electrodes 42 are arranged at the positions overlapped with the substantially central portions of the plurality of pressure chambers 10. The plurality of individual electrodes 42 extend to arrive at the positions at which they are not overlapped with the pressure chambers 10 on the side opposite to the nozzles 16 with respect to the longitudinal direction. The forward ends of the plurality of individual electrodes 42 are contacts 42*a* to make electric connection with an unillustrated flexible printed circuit board (FPC). The driving electric potential is applied to the individual electrode 42 by an unillustrated driver IC via FPC and the contact 42*a*.

A method for driving the piezoelectric actuator 31 will now be explained. The individual electrodes 42 are previously retained at the ground electric potential. When the driving electric potential is applied to any one of the plurality of individual electrodes 42 by the driver IC, then the difference in the electric potential arises in the piezoelectric layer 41 at the portion interposed between the individual electrode 42 to which the driving electric potential is applied and the vibration plate 40 which serves as the common electrode, and the electric field is generated in the thickness direction at the concerning portion of the piezoelectric layer 41. The direction of the electric field is the same as the direction of polarization of the piezoelectric layer 41. Therefore, the piezoelectric layer 41 is shrunk in the horizontal direction perpendicular to the thickness direction. The vibration plate 40, which is arranged on the lower surface of the piezoelectric layer 41, is deformed so that the vibration plate 40 is convex toward the lower side in accordance with the shrinkage of the piezoelectric layer 41. Accordingly, the volume of the pressure chamber 10 is decreased, and the pressure of the ink in the pressure chamber 10 is raised. Therefore, the ink is discharged from the nozzle 16 communicated with the pressure chamber 10. When the individual electrode 42 is restored to the ground electric potential, then the deformation is restored, and the volume of the pressure chamber 10 is increased. Accordingly, the pressure in the pressure chamber 10 is lowered. The ink is introduced into the pressure chamber 10 from the manifold flow passage 11 communicated with the pressure chamber 10.

In this situation, the pressure wave is generated in the pressure chamber 10 due to the fluctuation of the pressure of the ink in the pressure chamber 10. However, the volume of the manifold flow passage 11 is sufficiently secured as described above. Therefore, the pressure wave, which is transmitted from the pressure chamber 10 to the manifold flow passage 11, can be efficiently attenuated in the manifold flow passage 11.

Next, a method for producing the ink-jet head 3 will be explained.

In order to produce the ink-jet head 3, at first, flow passage holes for constructing the ink flow passages are formed through the plates 21 to 27. In particular, the etching is performed to the plates 21 to 24 to form the plurality of pressure chambers 10, the plurality of through-holes 12, 14, the plurality of apertures 13, and the plurality of through-holes 15*a*, 15*b*, 15*c*. The plurality of nozzles 16 are formed through the nozzle plate 27 by the press working.

Figure 9A:
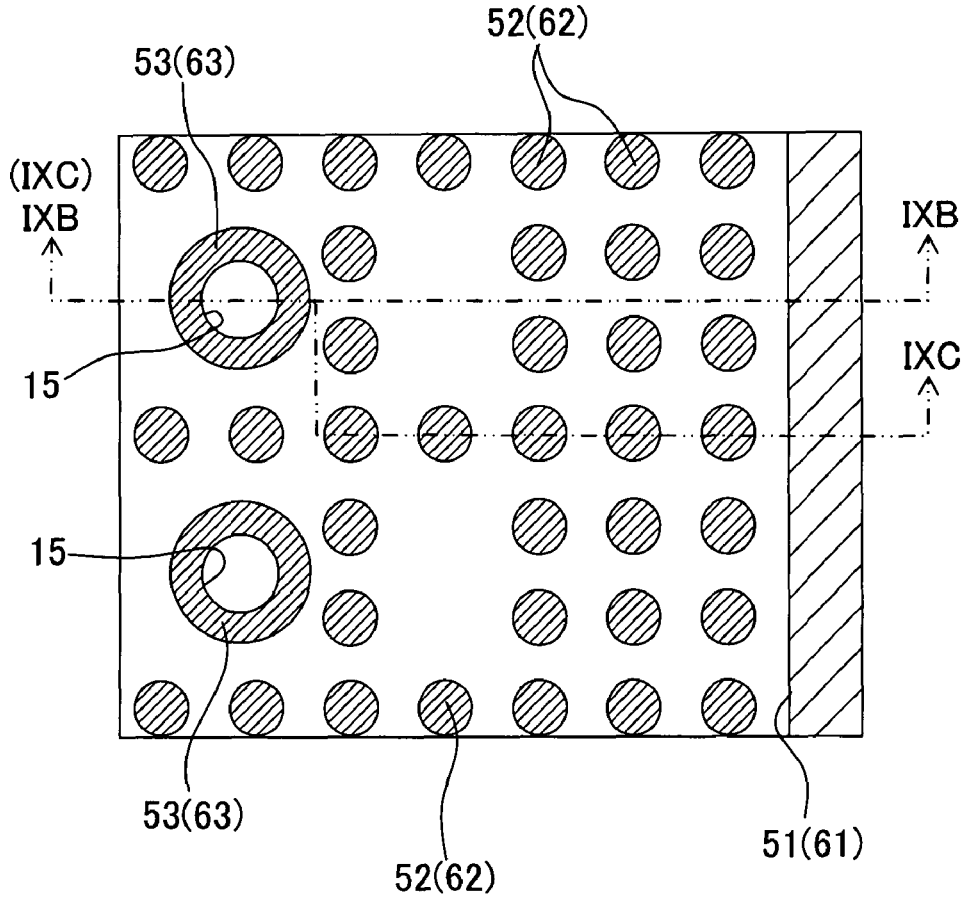
FIGS. 9A to 9C show a former half of the steps of producing the manifold plate.
Figure 9B:
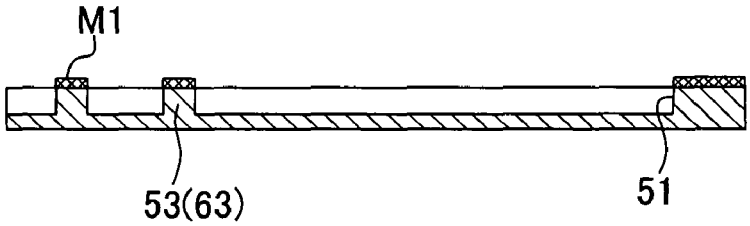
Figure 9C:
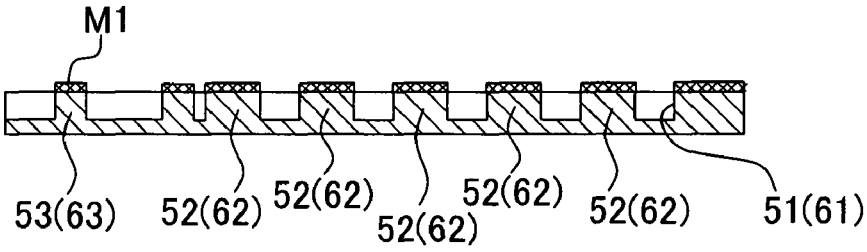
Figure 10A:
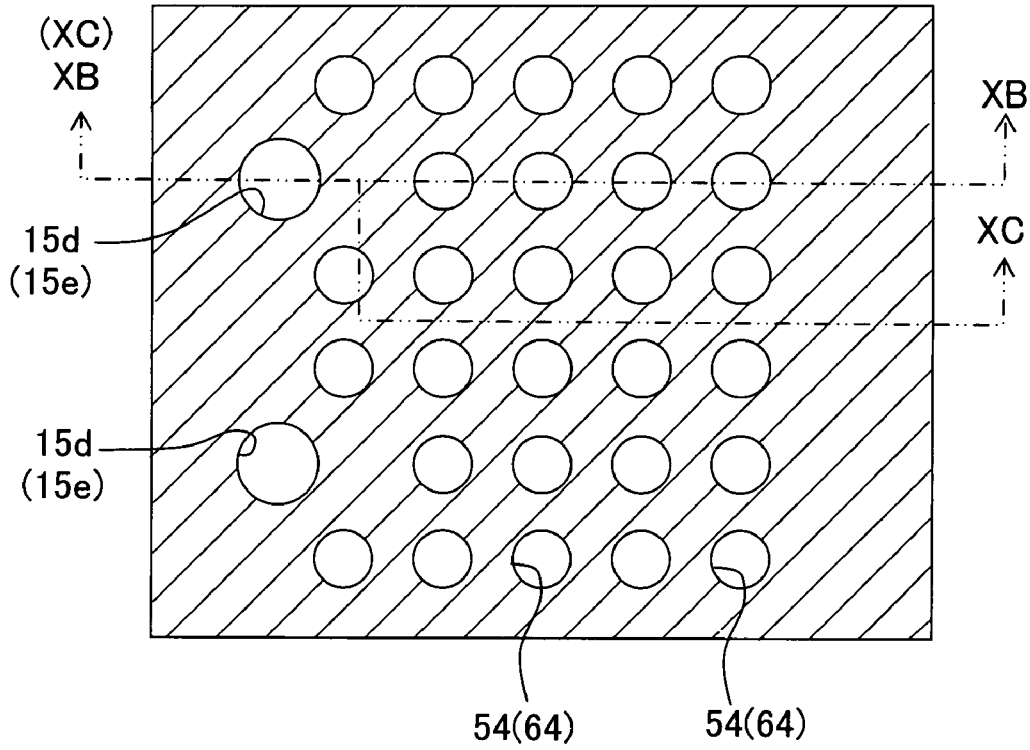
FIGS. 10A to 10C show a latter half of the steps of producing the manifold plate.
Figure 10B:
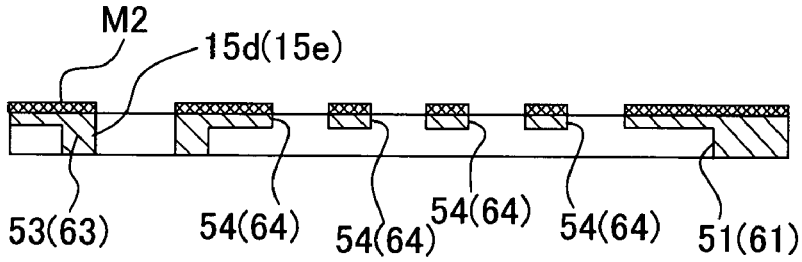
Figure 10C:
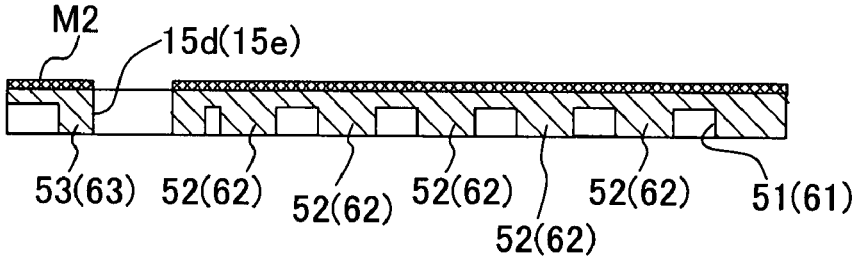

A method for forming the flow passage holes through the manifold plates 25, 26 will be explained with reference to FIGS. 9 and 10. FIG. 9 shows a former half of the steps of forming the flow passage holes through the manifold plates 25, 26. FIG. 9A shows a plan view, and FIGS. 9B and 9C are a sectional view taken along a line IX(B)-IX(B) and a sectional view taken along a line IX(C)-IX(C) respectively. FIG. 10 shows a latter half of the steps of forming the flow passage holes through the manifold plates 25, 26. FIG. 10A shows a plan view, and FIGS. 10B and 10C are a sectional view taken along a line X(B)-X(B) and a sectional view taken along a line X(C)-X(C) respectively.

In order to form the flow passage holes through the manifold plates 25, 26, as shown in FIG. 9, the areas of the upper surfaces of the manifold plates 25, 26 except for the portions for forming the through-holes 15*d*, 15*e*, which are included in the areas overlapped with the portions to surround the recess 51, the areas overlapped with the portions to be formed into the projections 52, 62, and the areas overlapped with the portions to be converted into the projections 53, 63, are covered with the mask M1, and the half etching is performed from the concerning surface. Accordingly, substantially half portions of the recesses 51, 61, the projections 52, 62, 53, 63, and the through-holes 15*d*, 15*e*, which are disposed on the side of the concerning surface, are formed. After that, the mask M1 is removed.

Subsequently, as shown in FIG. 10, the areas of the lower surfaces (surfaces disposed on the side opposite to the surface) of the manifold plates 25, 26 except for the portions for forming the through-holes 54, 64 and the through-holes 15*d*, 15*e* are covered with the mask M2. The etching is performed from the concerning surface. Accordingly, the through-holes 54, 64 and the through-holes 15*d*, 15*e* are formed. After that, the mask M2 is removed.

As described above, the half etching is performed to the manifold plate 25, 26 from the upper surface, and the etching is performed thereto from the lower surface. Accordingly, the recess 51, the plurality of projections 52, 53, and the through-holes 54, 15*d* can be easily formed for the manifold plate 25, and the recess 61, the plurality of projections 62, 63, and the through-holes 64, 15*e* can be easily formed for the manifold plate 26.

Subsequently, the plates 21 to 27 and the previously manufactured vibration plate 40 are stacked so that they are in the positional relationship as described above. The plates 21 to 27 and the vibration plate 40 are joined to one another by the metal diffusion bonding in which the heating is performed while applying the pressure to the plates 21 to 27 and the vibration plate 40 by pressing them from the both sides in the stacking direction.

When the plates 21 to 27 and the vibration plate 40 are joined to one another, it is necessary that the pressure is applied in the stacking direction as described above. According to above described structure, the projections 52, 53 and the projections 62, 63 are formed for the recesses 51, 61 which are the relatively large spaces. The forward ends of the projections 52, 53 and the projections 62, 63 make contact with the lower surface of the supply plate 24 and the lower surface of the manifold plate 25 respectively. Accordingly, the pressure can be sufficiently applied to the portions of the respective plates overlapped with the projections 52, 53, 62, 63 as viewed in a plan view, i.e., the portions overlapped with the recesses 51, 61 (manifold flow passage 11) as viewed in a plan view to which the pressure would be otherwise hardly applied. Accordingly, the plates 21 to 27 and the vibration plate 40 are joined to one another in such a state that they sufficiently make tight contact with each other. Therefore, it is possible to avoid the inconvenience which would be otherwise caused such that any gap appears between the joined plates 21 to 27 and the vibration plate 40, and the ink consequently leaks from the gap.

Further, the manifold plates 25, 26 have the same shape and the same arrangement. Therefore, the projections 52 and the projections 62 are completely overlapped with each other, and the projections 53 and the projections 63 are completely overlapped with each other as viewed in a plan view. Therefore, the larger pressure can be applied to the portions of the respective plates with which the projections 52, 53, 62, 63 are overlapped as viewed in a plan view. The plates are joined to one another in the state in which they are further adhered to one another or make tight contact with each other. The types of parts can be decreased, and the production steps are simplified, because the manifold plate 25 is the same part as the manifold plate 26.

Additionally, parts of the plurality of projections 52, 62 are formed at the positions overlapped with the portions to serve as the side walls of the pressure chambers 10 as viewed in a plan view. Accordingly, the large pressure can be applied to the plurality of plates 21 to 27 and the vibration plate 40.

The space to serve as the pressure chamber 10 is also formed in addition to the space to serve as the manifold flow passage 11 at the portion which is included in the portion overlapped with the manifold flow passage 11 as viewed in a plan view and which is overlapped with the pressure chamber 10 as well. Therefore, the pressure would be especially hardly applied to the portion. However, the pressure can be also applied to such a portion owing to the fact that parts of the plurality of projections 52, 62 are formed at the portions overlapped with the pressure chambers 10 as viewed in a plan view.

The projections 52, 53, 62, 63 have the substantially columnar shapes. Therefore, the volume of the manifold flow passage 11 can be sufficiently secured, while increasing the contact areas of the projections 52, 53 with respect to the supply plate 24 and the contact areas of the projections 62, 63 with respect to the manifold plate 25.

The piezoelectric layer 41 is formed, for example, by the aerosol deposition method (AD method), the sputtering method, or CVD on the surface of the vibration plate 40 of the formed stack of the flow passage unit 30 and the vibration plate 40, and the individual electrodes 35 are formed on the upper surface of the piezoelectric layer 41. Thus, the ink-jet head 3 is produced as described above.

According to the embodiment explained above, the forward ends of the projections 52, 53 make contact with the lower surface of the supply plate 24, and the forward ends of the projections 62, 63 make contact with the lower surface of the manifold plate 25. Therefore, when the plates 21 to 27 and the vibration plate 40 are joined to one another, the pressure can be sufficiently applied to the portions overlapped with the projections 52, 53, 62, 63 as viewed in a plan view. Accordingly, the plates 21 to 27 and the vibration plate 40 can be joined to one another in the state in which the joined plates 21 to 27 and the vibration plate 40 sufficiently make tight contact with each other. Therefore, it is possible to avoid the inconvenience which would be otherwise caused such that any gap appears between the joined plates 21 to 27 and the vibration plate 40, and the liquid leaks from the gap.

In this case, the manifold plate 25 and the manifold plate 26 have the same shape, and the projections 52, 62 and the projections 53, 63 are overlapped with each other respectively as viewed in a plan view. Therefore, it is possible to apply the larger pressure. Further, the types of parts can be decreased, and the production of the ink-jet head 3 (manufacturing of the flow passage unit 30) is simplified, because the manifold plate 25 and the manifold plate 26 have the same shape.

Further, parts of the plurality of projections 52, 62 are formed at the positions overlapped with the portions to serve as the side walls of the pressure chambers 10 as viewed in a plan view. Accordingly, the large pressure can be applied to the plurality of plates 21 to 27 and the vibration plate 40.

Additionally, the pressure would be especially hardly applied to the portion which is included in the portion overlapped with the common liquid chamber 11 as viewed in a plan view and which is overlapped with the pressure chamber 10 as well. However, the pressure can be also applied to such a portion owing to the fact that parts of the plurality of projections 52, 62 are formed at the portions overlapped with the pressure chambers 10 as viewed in a plan view.

The recess 51, the plurality of projections 52, 53, and the through-holes 54 can be easily formed for the manifold plate 25, and the recess 61, the plurality of projections 62, 63, and the through-holes 64 can be easily formed for the manifold plate 26 by performing the half etching to the manifold plates 25, 26 from the upper surfaces and performing the etching from the lower surfaces.

The pressure wave is absorbed in the manifold flow passage 11 by the projections 52, 53, 62, 63 provided in the manifold flow passage 11. Therefore, it is possible to efficiently attenuate the pressure wave. Further, the flow passage resistance is increased in the manifold flow passage 11 owing to the fact that the projections 52, 53, 62, 63 are provided. Therefore, for example, even when the ink is continuously supplied from the manifold flow passage 11 to the plurality of pressure chambers 10, the flow of the ink hardly arises in the manifold flow passage 11. Therefore, even when the supply of the ink is suddenly stopped, in accordance with the printing data, for a certain pressure chamber 10 having been continuously supplied with the ink, it is possible to avoid the outflow of the ink which would be otherwise caused by the flow from the manifold flow passage 11 to the pressure chamber 10 for which the supply of the ink has been stopped.

The recess 51 and the recess 61 are communicated with each other via the plurality of through-holes 54 to form one manifold flow passage 11. Therefore, the volume of the manifold flow passage 11 can be sufficiently secured. It is possible to efficiently attenuate the pressure wave in the manifold flow passage 11.

The recesses 51, 61 are formed to range over the two pressure chamber rows 8. The portions of the recesses 51, 61, which are overlapped with the two pressure chamber rows 8 as viewed in a plan view, are communicated with each other via the portions of the recess 51 between the projections 53 and the portions of the recess 61 between the projections 63. Therefore, the volume of the manifold flow passage 11 can be sufficiently secured. It is possible to more efficiently attenuate the pressure wave in the manifold flow passage 11.

The plurality of pressure chambers 10 are arranged at the equal intervals in the upward-downward direction as shown in FIG. 2, the plurality of projections 52, 62 and the through-holes 54, 64 are arranged at the equal intervals in the upward-downward direction as shown in FIG. 2, and the plurality of projections 53,63 are arranged at the equal intervals in the upward-downward direction as described in FIG. 2 corresponding to the plurality of pressure chambers 10. Therefore, the same positional relationship is provided between all of the respective pressure chambers 10 and all of the projections 52, 53, 62, 63 and the through-holes 54, 64 arranged in the vicinity of the respective pressure chambers 10. Accordingly, the flow passage resistance is uniform around the plurality of pressure chambers 10 in the manifold flow passage 11. It is possible to suppress the occurrence of any dispersion in the discharge characteristic of the ink to be discharged from the plurality of nozzles 16.

Further, the rows of the through-holes 54, 64 arranged in the upward-downward direction as shown in FIG. 2 are arranged between the rows of the projections 52, 62 arranged in the upward-downward direction as shown in FIG. 2. Therefore, the projections 52 and the through-holes 54 as well as the projections 62 and the through-holes 64 are arranged uniformly respectively in the manifold flow passage 11. Accordingly, the flow passage resistance is uniform over the entire region of the manifold flow passage 11. The ink can be reliably supplied from the manifold flow passage 11 to all of the pressure chambers 10.

The projections 52, 53, 62, 63 have the substantially columnar shapes. Therefore, it is possible to sufficiently secure the volume of the manifold flow passage 11 while increasing the contact areas of the projections 52, 53 with respect to the supply plate 24 and the contact areas of the projections 62, 63 with respect to the manifold plate 25.

Next, an explanation will be made about modified embodiments in which various modifications are applied to the embodiment of the present invention. However, those constructed in the same manner as those of the embodiment of the present invention are designated by the same reference numerals, any explanation of which will be appropriately omitted.

Figure 11:
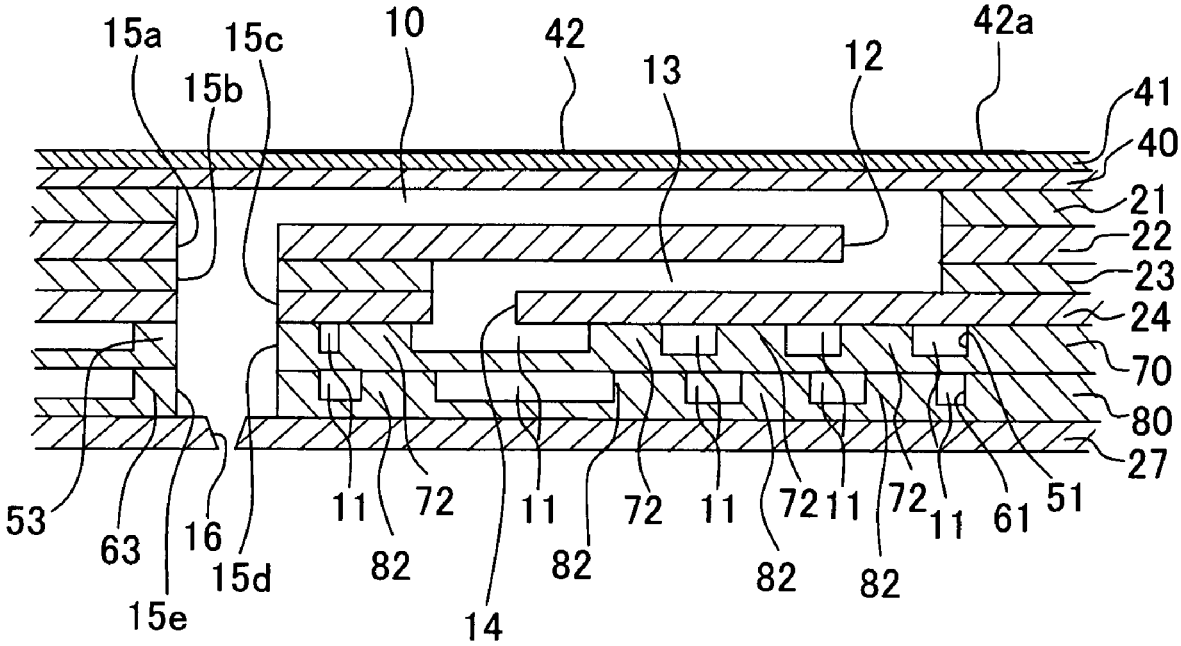
FIG. 11 shows a sectional view illustrating a first modified embodiment corresponding to FIG. 5.

In the first modified embodiment, as shown in FIG. 11, a plurality of projections 72 formed for a manifold plate 70 are overlapped only partially with a plurality of projections 82 formed for a manifold plate 80 as viewed in a plan view. Also in this case, the projections 72 and the projections 82 are partially overlapped with each other as viewed in a plan view. Therefore, when the plates 21 to 24, 27, 70, 80 and the vibration plate 40 are joined to one another, it is possible to apply the large pressure to the portions which are overlapped with the projections 72 and the projections 82. The plates 21 to 24, 27, 70, 80 and the vibration plate 40 can be joined to one another in a state in which they sufficiently make tight contact with each other.

Figure 12:
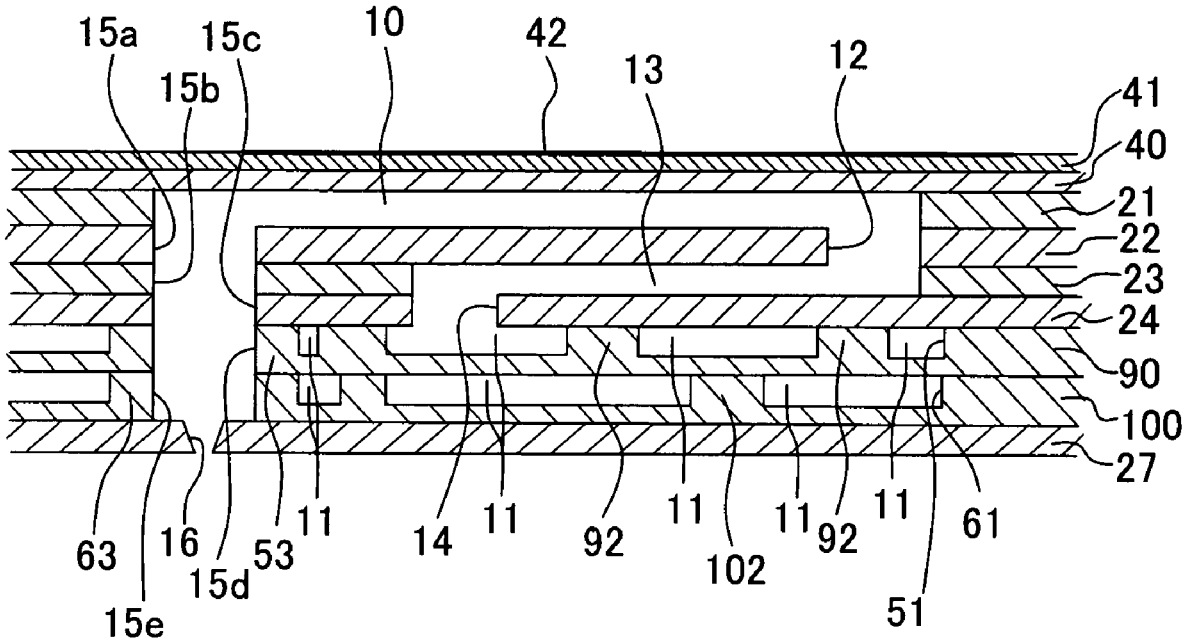
FIG. 12 shows a sectional view illustrating a second modified embodiment corresponding to FIG. 5.

In the second modified embodiment, as shown in FIG. 12, projections 102 formed for a manifold plate 100 are positioned between two adjoining projections 92 formed for a manifold plate 90 as viewed in a plan view. In other words, the arrangement is made so that the projections 92 and the projections 102 are not overlapped with each other as viewed in a plan view. Also in this case, the forward ends of the projections 92 make contact with the lower surface of the supply plate 24, and the forward ends of the projections 102 make contact with the lower surface of the manifold plate 90. Therefore, when the plates 21 to 24, 27, 90, 100 and the vibration plate 40 are joined to one another, it is possible to apply the pressure to the portions which are overlapped with the projections 92, 102 as viewed in a plan view. The joining can be performed in a state in which the plates 21 to 24, 27, 90, 100 and the vibration plate 40 sufficiently make tight contact with each other.

Figure 13:
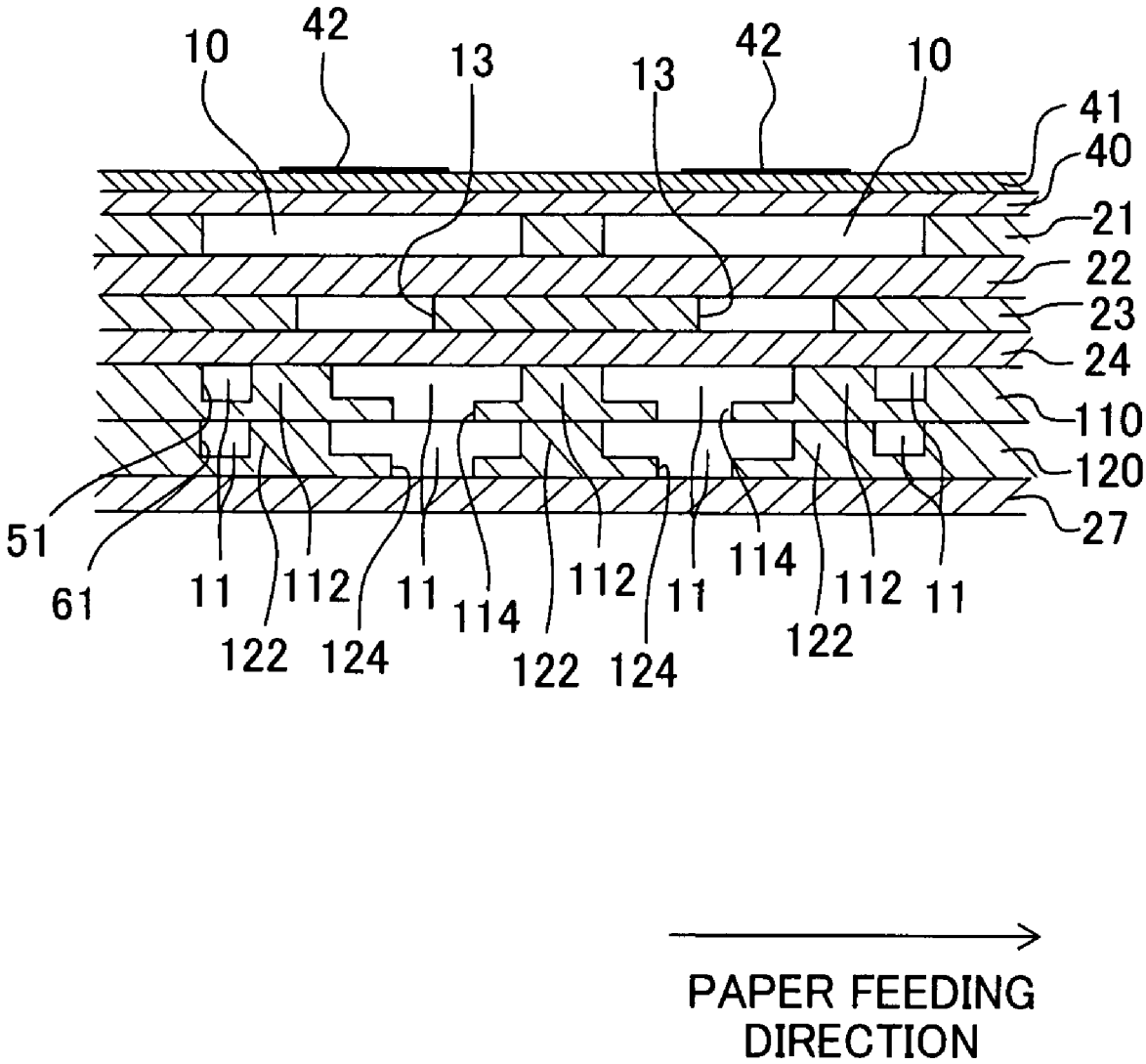
FIG. 13 shows a sectional view illustrating a third modified embodiment corresponding to FIG. 6.

In the third embodiment, as shown in FIG. 13, through-holes 114 are formed between two projections 112 which are adjacent to one another with respect to the transverse direction of the pressure chambers 10 (transverse direction as shown in FIG. 13) and which are included in a plurality of projections 112 formed for a manifold plate 110. Further, through-holes 124 are formed between two projections 122 which are adjacent to one another with respect to the transverse direction of the pressure chambers 10 and which are included in a plurality of projections 122 formed for a manifold plate 120. In other words, the projections 112 and the through-holes 114 as well as the projections 122 and the through-holes 124 are arranged alternately with respect to the transverse direction of the pressure chambers 10 respectively. In this case, the projections 112 and the through-holes 114 as well as the projections 122 and the through-holes 124 are arranged uniformly in the manifold flow passage 11 respectively. Therefore, the flow passage resistance is uniform in the manifold flow passage 11. The ink is supplied reliably from the manifold flow passage 11 to all of the pressure chambers 10.

Figure 4:
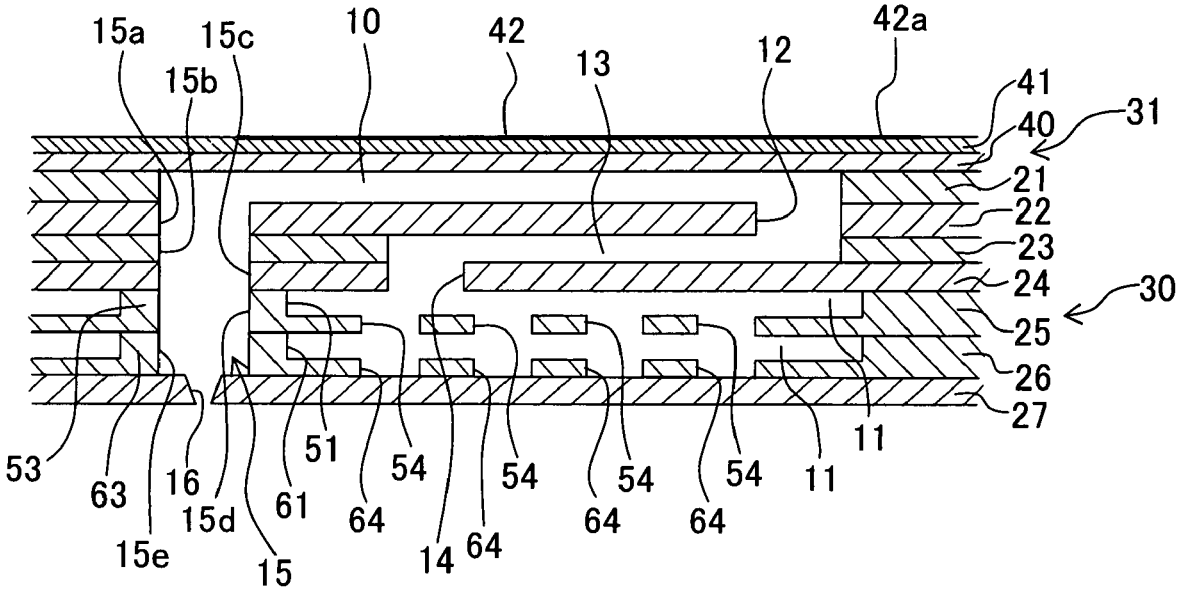
FIG. 4 shows a sectional view taken along a line IV-IV shown in FIG. 3.
Figure 5:
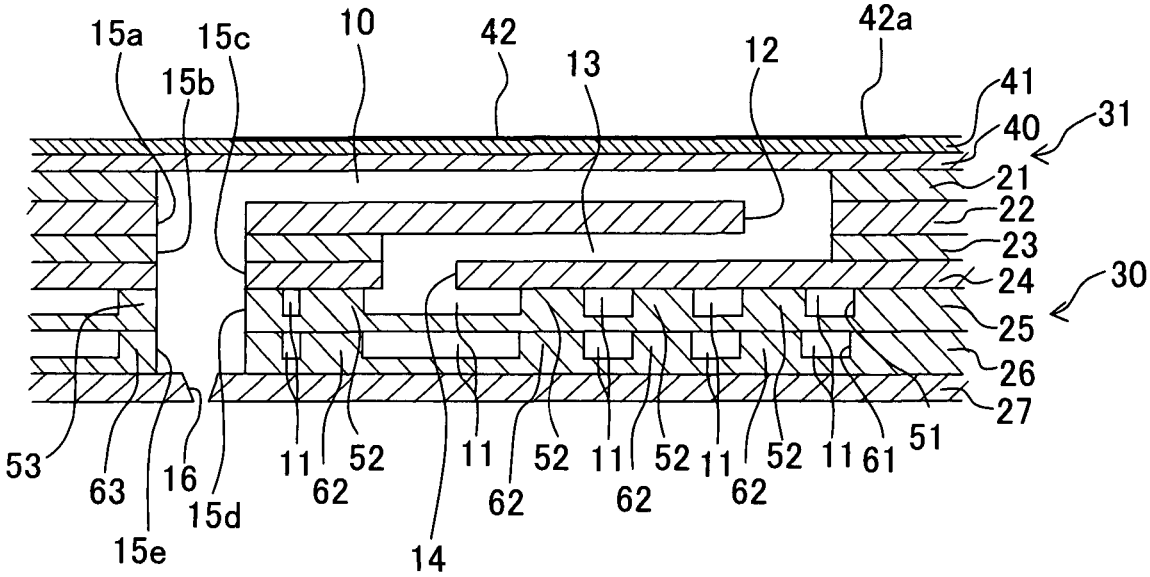
FIG. 5 shows a sectional view taken along a line V-V shown in FIG. 3.
Figure 6:
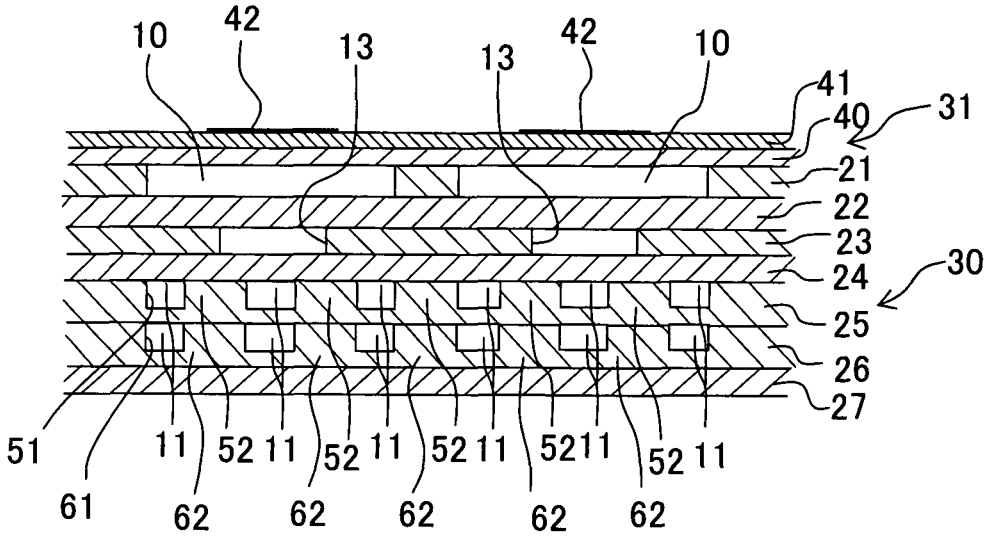
FIG. 6 shows a sectional view taken along a line VI-VI shown in FIG. 3.
Figure 7:
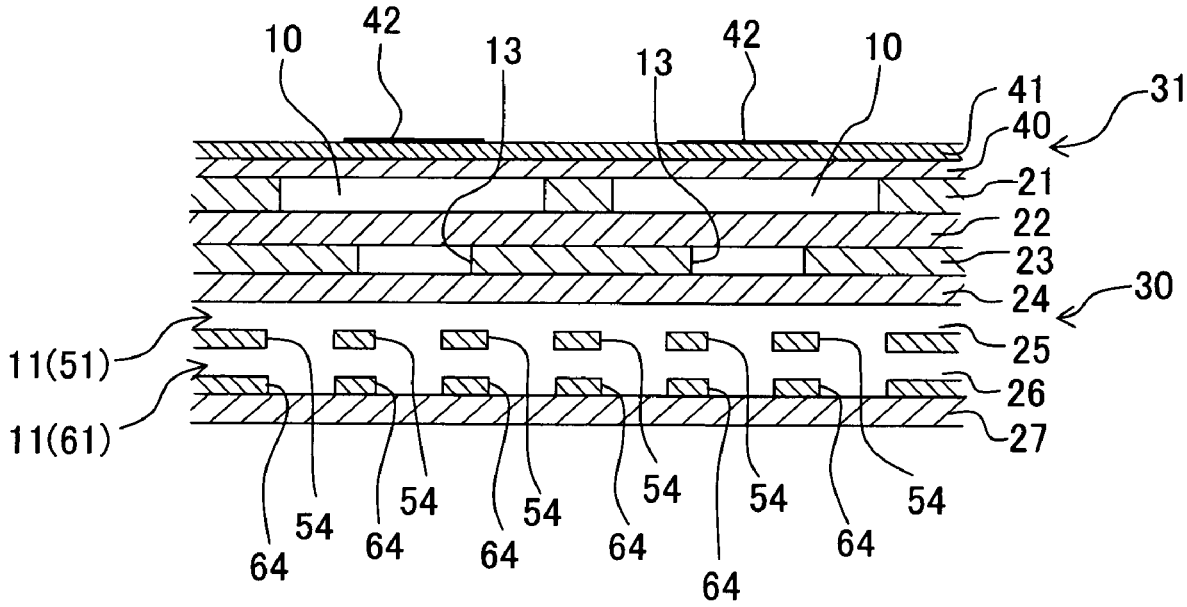
FIG. 7 shows a sectional view taken along a line VII-VII shown in FIG. 3.
Figure 14:
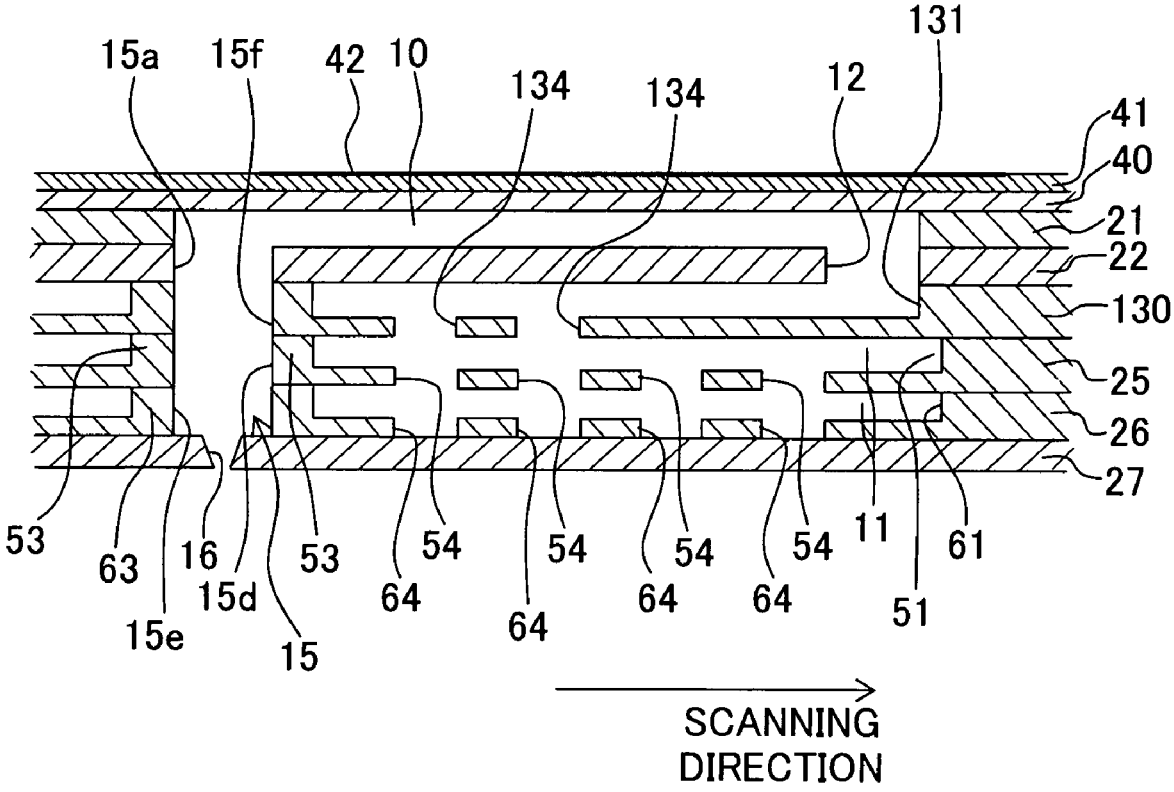
FIG. 14 shows a sectional view illustrating a fourth modified embodiment corresponding to FIG. 4.

In the fourth modified embodiment, as shown in FIG. 14, a plate 130 is stacked between the base plate 22 and the manifold plate 25 in place of the arrangement in which the aperture plate 23 and the supply plate 24 of the embodiment of the present invention are stacked between the base plate 22 and the manifold plate 25 (see FIG. 4). A plurality of recesses 131, which extend from portions disposed at substantially central portions of the pressure chambers 10 in the transverse direction and overlapped with the through-holes 12 as viewed in a plan view to the vicinity of the descender flow passage 15 in the longitudinal direction of the pressure chambers 10, are formed on the upper surface of the plate 130 corresponding to the plurality of pressure chambers 10. Two through-holes 134, which are aligned in the longitudinal direction of the pressure chamber 10 from the vicinity of the descender flow passage 15, are formed for each of the plurality of recesses 131. Further, a through-hole 15*f* is formed at the portion of the plate 130 overlapped with the descender flow passage 15 as viewed in a plan view. In this case, the recess 51 is communicated with the pressure chamber 10 via the two through-holes 134, the recess 131, and the through-hole 12. The portion of the recess 131 overlapped with the through-holes 134 disposed on the right side as shown in FIG. 14 as viewed in a plan view and the portion disposed on the left side as compared with the foregoing portion are parts of the manifold flow passage. The portion, which is disposed on the right side as compared with the portion overlapped with the through-hole 134 disposed on the right side as shown in FIG. 14 as viewed in a plan view is the aperture.

Figure 15:
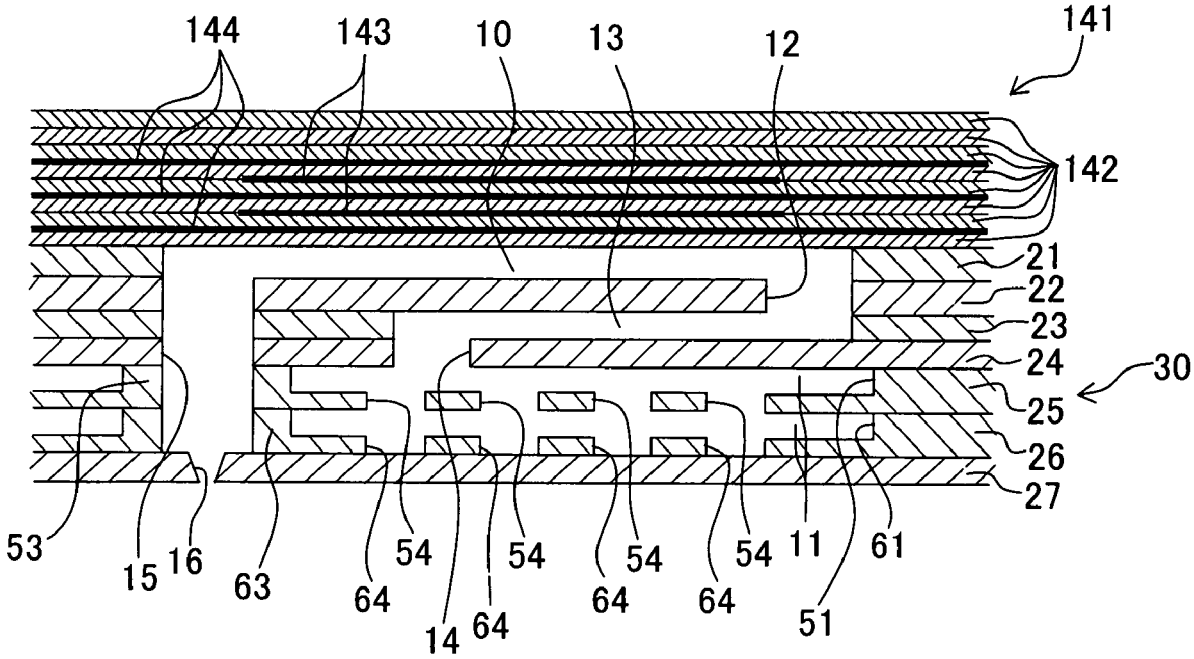
FIG. 15 shows a sectional view illustrating a fifth modified embodiment corresponding to FIG. 4.

In the fifth modified embodiment, as shown in FIG. 15, eight piezoelectric layers 142 are stacked on the upper surface of the cavity plate 21. A plurality of individual electrodes 143 are formed at positions overlapped with the pressure chamber 10 as viewed in a plan view between the second and third stacked piezoelectric layers 142 as counted from the bottom and between the stacked fourth and fifth piezoelectric layers 142 as counted from the bottom. Further, common electrodes 144 are formed over the entire regions respectively between the stacked first and second piezoelectric layers 142 as counted from the bottom, between the stacked third and fourth piezoelectric layers 142 as counted from the bottom, and between the fifth and sixth piezoelectric layers 142 as counted from the bottom. Accordingly, a piezoelectric actuator 141 is constructed. In this way, the piezoelectric actuator may be of the type different from that of the piezoelectric actuator 31 explained in the embodiment of the present invention. Further, any means other than the piezoelectric actuator is also available provided that the pressure can be applied to the ink in the pressure chamber 10.

Figure 16:
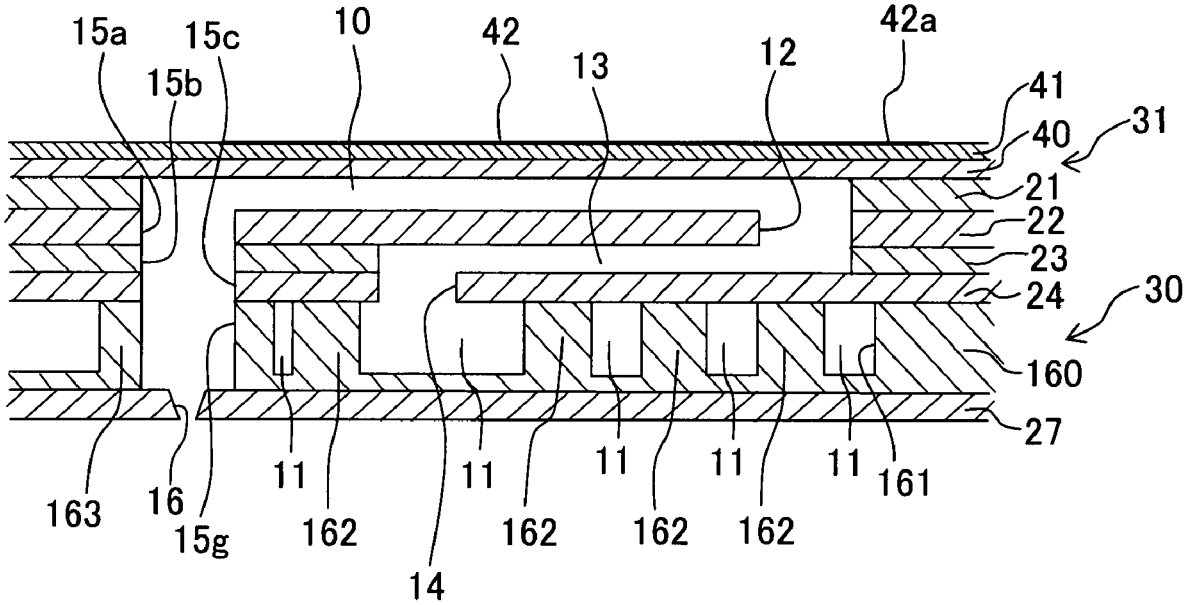
FIG. 16 shows a sectional view illustrating a sixth modified embodiment corresponding to FIG. 5.

In the sixth embodiment, as shown in FIG. 16, one manifold plate 160 (first plate) is allowed to intervene between the supply plate 24 (second plate) and the nozzle plate 27 without stacking a plurality of manifold plates. The manifold plate 160 is formed with a recess 161 which has the opening at the upper surface (one surface) thereof and which is overlapped with the two pressure chamber rows 8 as viewed in a plan view in the same manner as in the embodiment of the present invention. Projections 162, 163 extend in the recess 161 from the bottom wall of the recess 161 to make contact with the supply plate 24. The forward ends thereof are joined to the lower surface of the supply plate 24. A through-hole 15*g* is formed in the projection 163. However, no through-hole is formed at the bottom wall of the recess 161 unlike the embodiment of the present invention. Also in this case, the forward ends of the projections 162, 163 make contact with the lower surface of the supply plate 24. Therefore, the pressure can be sufficiently applied to the portions overlapped with the projections 162, 163 when the plates 21 to 24, 27, 160 and the vibration plate 40 are joined to one another. Therefore, the plates 21 to 24, 160, 27 and the vibration plate 40 can be joined to one another in a state in which they sufficiently make tight contact with each other. Also in this case, the ink-jet head 3 can be produced basically in the same manner as in the embodiment of the present invention such that the stack of the flow passage unit 30 and the vibration plate 40 is formed by formation of the flow passage hole and formation of the stack, and the piezoelectric layer 41 and the individual electrodes 35 are formed on the vibration plate 40. However, unlike the embodiment of the present invention, one manifold plate 160 is provided. Therefore, it is enough that the recess 161, the projections 162, 163, and the through-holes 15*f* are formed for only one manifold plate in the formation of the flow passage hole. Also in the formation of the stack, it is enough that one manifold plate 160 is joined to the other plates.

In the embodiment of the present invention, the plates 21 to 27 and the vibration plate 40 are joined to one another by the metal diffusion bonding. However, they may be joined to one another with an adhesive. When the plates 21 to 27 and the vibration plate 40 are joined to one another with the adhesive, it is also necessary to apply the pressure to the plates 21 to 27 and the vibration plate 40. The pressure can be also sufficiently applied to the portions at which the projections 52, 53, 62, 63 are formed as viewed in a plan view. Therefore, it is possible to avoid the appearance of any gap between the plates 21 to 27 and the vibration plate 40.

In the embodiment described above and the modified embodiments thereof, the explanation has been made about the example in which the present invention is applied to the ink-jet head 3 which is attached to the lower surface of the carriage 2 and which discharges the ink from the nozzles 16 formed on the lower surface while reciprocating in the scanning direction together with the carriage 2. However, the present invention is not limited thereto. The present invention is applicable to any ink-jet head which is formed by stacking a plurality of plates and which includes spaces such as the common liquid chamber and the pressure chambers formed therein. For example, the present invention is also applicable to a line type head in which a plurality of nozzles are aligned in series in the scanning direction. In this case, it is unnecessary to make the ink-jet head reciprocate in the scanning direction, and the carriage 2 is not essential.

In the embodiment described above and the modified embodiments thereof, the pressure-applying mechanism is formed such that the piezoelectric layer 41 is formed on the surface of the vibration plate 40, for example, by the aerosol deposition method (AD method), the sputtering method, or CVD, and the individual electrodes 35 are formed on the upper surface of the piezoelectric layer 41. However, the pressure-applying mechanism is not limited to the mechanism constructed as described above. For example, it is also allowable to utilize a sheet (green sheet) of a piezoelectric ceramic material in which a ceramic powder, a binder, and a solvent are mixed with each other to obtain a mixture which is formed to be flat so that the thickness of one sheet is about 30 μm. The pressure-applying mechanism can be formed such that electrode layers are formed with a conductive paste on surfaces of a plurality of sheets, and the plurality of green sheets are stacked and sintered.

The foregoing description has been made about the example in which the present invention is applied to the ink-jet head for discharging the ink from the nozzles. However, the present invention is applicable to any liquid transport apparatus provided that the liquid transport apparatus is provided with a flow passage unit in which pressure chambers, a liquid chamber for supplying a liquid to the pressure chambers, and flow passages for communicating the pressure chambers and the liquid chamber are formed by stacking a plurality of plates, and a pressure-applying mechanism which applies the pressure to the liquid in the pressure chambers, and the liquid transport apparatus has such a structure that the liquid chamber is formed by a recess formed on one surface of a predetermined plate and another plate for closing the recess, and projections, which extend from the bottom wall of the recess, make contact with the another plate for closing the recess. A supply port and a discharge port for the liquid to be supplied to and discharged from such a liquid transport apparatus can be provided at any portions depending on the way of use. The shape of the discharge port is not limited to the nozzle as well, for which any one having any shape can be adopted. The liquid to be transported is not limited to the ink. For example, the present invention is also applicable to any liquid transport apparatus for transporting any liquid other than the ink, including, for example, a chemical reagent, a biological solution, a wiring material solution, an electronic material solution, a liquid for refrigerant, and a liquid for fuel.

What is claimed is:

1. A liquid transport apparatus constructed by stacking a plurality of plates, comprising:

a flow passage unit which has liquid flow passages including a plurality of pressure chambers, a common liquid chamber for supplying a liquid to the plurality of pressure chambers, and communication flow passages communicating the plurality of pressure chambers and the common liquid chamber; and a pressure-applying mechanism which applies a pressure to the liquid in the plurality of pressure chambers, wherein:

the plurality of plates include a first plate and a second plate which is joined to a surface of the first plate;

a recess, which has an opening at the surface and which constructs the common liquid chamber, is formed for the first plate;

a projection is formed in the recess to extend from a bottom wall of the recess to make contact with the second plate; and the second plate makes contact with the surface of the first plate and a forward end of the projection to close the opening therewith.

2. The liquid transport apparatus according to claim 1, wherein the plurality of plates include a plurality of first plates and one piece of the second plate, the plurality of first plates are stacked adjacent to each other, the second plate is joined to a surface of a first plate which is positioned on an outermost side among the plurality of first plates and a first through-hole, which penetrates through each of the first plates, is formed through each of the plurality of first plates at a position different from that of the projection of the bottom wall of the recess.

3. The liquid transport apparatus according to claim 2, wherein the projections, which are formed on the plurality of first plates respectively, are overlapped with each other at least partially.

4. The liquid transport apparatus according to claim 3, wherein all of the plurality of first plates have an identical shape.

5. The liquid transport apparatus according to claim 2, wherein the projection is formed as a plurality of projections and the first through-hole is formed as a plurality of first through-holes in each of the plurality of first plates, and all of the plurality of pressure chambers and all of the projections and the first through-holes, formed in the vicinity of the plurality of pressure chambers respectively, are in a same positional relationship.

6. The liquid transport apparatus according to claim 5, wherein the plurality of pressure chambers are arranged at equal intervals in one direction, and the plurality of projections and the plurality of first through-holes are arranged at equal intervals in the one direction respectively.

7. The liquid transport apparatus according to claim 2, wherein the projection is formed as a plurality of projections and the first through-hole is formed as a plurality of first through-holes in each of the plurality of first plates, and each of the first through-holes is formed between the two adjoining projections among the plurality of projections.

8. The liquid transport apparatus according to claim 1, wherein the plurality of plates further include a third plate which is arranged on a side opposite to the first plate with respect to the second plate and which constructs the plurality of pressure chambers, flow passage holes constructing the communication flow passages are formed through the second plate, the recess is formed to have an area covering the plurality of pressure chambers, and the projection is formed between two adjoining pressure chambers among the plurality of pressure chambers.

9. The liquid transport apparatus according to claim 1, wherein the plurality of plates further include a third plate which is arranged on a side opposite to the first plate with respect to the second plate and which constructs the plurality of pressure chambers, flow passage holes constructing the communication flow passages are formed through the second plate, the recess is formed to have an area covering the plurality of pressure chambers, and the projection is formed at a portion overlapped with the plurality of pressure chambers.

10. The liquid transport apparatus according to claim 1, wherein the plurality of plates further include a third plate which is arranged on a side opposite to the first plate with respect to the second plate and which constructs the plurality of pressure chambers, flow passage holes constructing the communication flow passages are formed through the second plate, the plurality of pressure chambers form a plurality of pressure chamber rows in which the pressure chambers are arranged at equal intervals in one direction, the recess is formed to have an area covering the plurality of pressure chamber rows, the projection is formed in the recess as a plurality of projections, a part of the plurality of projections is arranged at equal intervals in the one direction corresponding to the plurality of pressure chambers, a plurality of second through-holes, which penetrate through the first plate, are formed in the part of the projections, the plurality of second through-holes construct transport flow passages which are communicated with the plurality of pressure chambers to transport the liquid in the plurality of pressure chambers, and portions of the recess, which are overlapped with the plurality of pressure chamber rows, are communicated with each other via portions located between the part of the projections through which the second through-holes are formed.

11. The liquid transport apparatus according to claim 1, wherein the projection has a columnar shape.

12. The liquid transport apparatus according to claim 1, wherein the liquid transport apparatus is a liquid-jetting apparatus further comprising a nozzle plate through which a plurality of nozzles are formed, the plurality of nozzles being communicated with the plurality of pressure chambers to jet the liquid.

13. A method for producing a liquid transport apparatus, comprising:

forming, through a plurality of plates, flow passage holes for constructing liquid flow passages including a plurality of pressure chambers, a common liquid chamber supplying a liquid to the plurality of pressure chambers, and communication flow passages communicating the plurality of pressure chambers and the common liquid chamber;

forming a flow passage unit having the liquid flow passages formed therein by stacking the plurality of plates through which the flow passage holes are formed; and providing, on the flow passage unit, a pressure-applying mechanism applying a pressure to the liquid in the plurality of pressure chambers, wherein:

the plurality of plates include a first plate and a second plate which is joined to a surface of the first plate, when the flow passage holes are formed, a recess which has an opening on the surface of the first plate and which constructs the common liquid chamber and a projection which extends from a bottom wall of the recess to make contact with the second plate are formed in the first plate.

14. The method for producing the liquid transport apparatus according to claim 13, wherein the plurality of plates include a plurality of first plates and one piece of the second plate, through-holes, which penetrate through the first plate, are formed at positions different from that of the projection of the bottom wall of the recess in the formation of the flow passage holes, and the plurality of plates are stacked in the formation of the flow passage unit so that the plurality of first plates are disposed adjacently to one another and that the second plate is joined to a surface of a first plate which is positioned on an outermost side among the plurality of first plates.

15. The method for producing the liquid transport apparatus according to claim 14, wherein in the formation of the flow passage holes, the recess and the projection are formed by performing half etching to a portion to be formed into the common liquid chamber which is different from a portion at which the projection is formed, from the surface of the first plate.

16. The method for producing the liquid transport apparatus according to claim 14, wherein in the formation of the flow passage holes, the through-holes are formed by performing etching to portions, at which the through-holes are formed, from a surface on a side opposite to the surface of the first plate.

17. The method for producing the liquid transport apparatus according to claim 13, wherein the plurality of plates are joined to one another with an adhesive in the formation of the flow passage unit.

18. The method for producing the liquid transport apparatus according to claim 13, wherein the plurality of plates are formed of a metal material, and the plurality of plates are joined to one another by metal diffusion bonding in the formation of the flow passage unit.

* * * * *